US012472403B2

(12) United States Patent
Schranz

(10) Patent No.: US 12,472,403 B2
(45) Date of Patent: Nov. 18, 2025

(54) APPARATUS AND METHOD FOR PHYSIOTHERAPY

(71) Applicant: Paul Steven Schranz, Bowen Island (CA)

(72) Inventor: Paul Steven Schranz, Bowen Island (CA)

( * ) Notice: Subject to any disclaimer, the term of this patent is extended or adjusted under 35 U.S.C. 154(b) by 279 days.

(21) Appl. No.: 17/882,538

(22) Filed: Aug. 6, 2022

(65) Prior Publication Data

US 2023/0045622 A1 Feb. 9, 2023

Related U.S. Application Data

(60) Provisional application No. 63/256,632, filed on Oct. 17, 2021, provisional application No. 63/254,173, filed on Oct. 11, 2021, provisional application No. 63/230,370, filed on Aug. 6, 2021.

(51) Int. Cl.
*A63B 24/00* (2006.01)
*A63B 22/02* (2006.01)

(52) U.S. Cl.
CPC ..... *A63B 24/0087* (2013.01); *A63B 22/0235* (2013.01); *A63B 2220/20* (2013.01)

(58) Field of Classification Search
CPC ..... A63B 19/00; A63B 19/04; A63B 21/0051; A63B 21/0058; A63B 21/023; A63B 21/0442; A63B 21/0552; A63B 21/4009; A63B 21/4049; A63B 22/02; A63B 22/0235; A63B 23/02; A63B 24/0087; A63B 2023/003; A63B 2220/20
See application file for complete search history.

(56) References Cited

U.S. PATENT DOCUMENTS 3,083,037 A * 3/1963 Gordon ..... A63B 19/04 482/146
3,276,777 A * 10/1966 Pruitt, Sr. ..... A63B 19/04 472/17
3,936,047 A * 2/1976 Brandt ..... A63G 31/00 482/130
4,296,924 A 10/1981 Anzaldua
4,456,245 A 6/1984 Baldwin
4,725,055 A 2/1988 Skowronski
4,732,381 A 3/1988 Skowronski
4,749,184 A 6/1988 Tobin
5,000,440 A 3/1991 Lynch
5,039,091 A 8/1991 Johnson
5,046,721 A * 9/1991 Altare ..... A63B 19/04 482/17
5,072,932 A 12/1991 Johnson
5,104,119 A 4/1992 Lynch
5,171,196 A 12/1992 Lynch
5,342,244 A * 8/1994 Nelson ..... A63B 19/04 472/17
5,698,782 A 12/1997 Gledhill
(Continued)

*Primary Examiner* — Joshua Lee

(57) ABSTRACT

An improved apparatus for physiotherapy includes a lever arm. A biasing device pivotally biases the lever arm about a pivot axis. There is a support configured for supporting the lever arm above an exercise equipment. A harness is configurable on a torso of a user to couple the user to the lever arm. The pivot axis corresponds to an anatomical longitudinal axis of the user and the torso of the user is biased by the lever arm about the anatomical longitudinal axis.

19 Claims, 34 Drawing Sheets

(56) References Cited

U.S. PATENT DOCUMENTS 5,941,807 A * 8/1999 Cassidy ..... A63B 21/4009 482/130
RE37,132 E 4/2001 Douglas
6,371,863 B1 4/2002 Moran
6,402,667 B1 * 6/2002 Dahn ..... A63B 21/00069 482/121
6,520,891 B1 2/2003 Stephens, Jr.
6,554,747 B1 * 4/2003 Rempe ..... A63B 21/4011 482/69
6,786,855 B2 * 9/2004 Prichard ..... A63B 21/04 482/127
7,081,074 B1 7/2006 Rubin
7,104,926 B2 * 9/2006 Carlson ..... A63B 21/023 601/39
7,494,450 B2 2/2009 Solomon
7,641,595 B2 1/2010 Sharps
7,651,450 B2 * 1/2010 Wehrell ..... A63B 21/4007 482/129
7,878,950 B1 2/2011 Bastian
7,887,471 B2 * 2/2011 McSorley ..... A63B 21/0552 482/136
8,221,295 B2 7/2012 Wilkins
8,360,942 B2 * 1/2013 Goel ..... A63B 23/02 482/130
8,663,075 B2 3/2014 Reyes
8,992,393 B2 3/2015 Reyes
9,056,240 B2 * 6/2015 Carrell ..... A63C 17/1436
9,302,150 B2 * 4/2016 Tsuzuki ..... A63B 21/0628
9,498,696 B1 11/2016 Razon
9,675,838 B2 6/2017 Manzke
9,713,439 B1 * 7/2017 Wu ..... A61B 5/221
9,914,003 B2 * 3/2018 Kuehne ..... A63B 71/0009
10,192,454 B2 * 1/2019 Cakmak ..... A63B 24/00
10,376,734 B1 8/2019 Razon
10,383,784 B2 8/2019 Murphy
10,493,309 B2 12/2019 Jue
10,583,320 B2 * 3/2020 Schranz ..... A63B 22/0046
10,765,911 B1 * 9/2020 Hamoy ..... A63B 23/0205
10,857,407 B2 12/2020 Crist
10,918,926 B2 * 2/2021 Pennington ..... A63B 23/1227
11,007,401 B2 5/2021 Kennedy
11,083,929 B2 * 8/2021 Bertrand ..... A63B 24/0075
11,383,062 B2 * 7/2022 Brodsky ..... A63B 22/02
2002/0026130 A1 2/2002 West
2003/0114238 A1 6/2003 Meneghini
2003/0158021 A1 * 8/2003 Prichard ..... A63B 21/04 482/130
2004/0033863 A1 2/2004 Carlson
2007/0054785 A1 3/2007 Drechsler
2007/0072694 A1 3/2007 Meneghini
2007/0161470 A1 7/2007 Berryman
2007/0161472 A1 7/2007 Drechsler
2008/0287267 A1 11/2008 Ellis
2009/0118103 A1 5/2009 Ellis
2011/0082011 A1 4/2011 Ellis
2011/0118089 A1 5/2011 Ellis
2011/0118090 A1 5/2011 Ellis
2011/0281691 A1 11/2011 Ellis
2015/0087448 A1 3/2015 Huang
2015/0111707 A1 * 4/2015 Yan ..... A63B 21/4035 482/78
2016/0001118 A1 1/2016 Kuehne
2016/0166460 A1 6/2016 Murphy
2016/0339294 A1 11/2016 Blach
2018/0326255 A1 * 11/2018 Schranz ..... A63B 21/08
2020/0222753 A1 7/2020 Schranz
2020/0222754 A1 * 7/2020 Walker ..... A63B 23/025

* cited by examiner

Detail E

Section H-H

Section A-A

Section C-C

Section B-B

APPARATUS AND METHOD FOR PHYSIOTHERAPY

CROSS-REFERENCE TO RELATED APPLICATION(S)

This application claims the benefit of U.S. Provisional Patent Application No. 63/230,370, filed Aug. 6, 2021, and U.S. Provisional Patent Application No. 63/254,173, filed Oct. 11, 2021, and U.S. Provisional Patent Application No. 63/256,632, filed Oct. 17, 2021 all of which are incorporated by reference herein in their entirety.

TECHNICAL FIELD

The present application relates to an apparatus and method of physiotherapy, and more particularly to a rehabilitative apparatus and method of physiotherapy.

BACKGROUND

Many people suffer from back and buttock pain for a variety of reasons. One reason for the pain may be muscle imbalances and/or compensations in the body resulting from use patterns, leg length differences, injuries, hips dysplasia, ankle disorders, congenital issues as well as other factors. Acute pain comes on suddenly and typically lasts less than six weeks, for example, which may be caused by a fall or heavy lifting. Chronic pain can last more than three months, for example, and some people suffering from chronic pain may have a level of pain consistently. Leg length differences are common in the general population. The leg length difference may be anatomical, where the measurement from the bony protuberance (the greater trochanter) of the hip joint to the lateral ankle measures shorter on one side than the other, or the difference may be functional where the measurement from the same two points is equal on both sides, but there is still an apparent short leg. Pelvic obliquity, a rotation or displacement of the pelvis on one or both sides, is associated with leg length discrepancies, and may cause abnormal stress on muscles, nerves, and joints involved. The longer a person has a leg length discrepancy the greater the chance for a secondary compensatory problem somewhere else in the body, usually in the upper back, shoulders or neck. Common symptoms include muscular pains in the involved areas, headaches, numbness and/or tingling in the arms or hands. Muscles of the back are also affected by this asymmetry. One side will be overstretched and subject to strain and spasm; the other side will become contracted and shorter. The uneven load on the hips and knees can result in arthritis in those joints as well as shin splints, ankle problems, and heel pains. Various muscle groups can develop asymmetrically over time due to the habitual asymmetrical loading pattern. The firing order for the muscles during movement, such as walking, running, cycling and swimming, may become less optimal compared to a person without a leg length discrepancy. The head of the femur may be less optimally seated in the acetabulum in one or both legs due these muscle imbalances and less favorable muscle firing order, further impacting movement patterns and athletic performance. Once these muscle patterns have become ingrained in the body it is very difficult to correct them, even after adjusting for a leg length difference with a lift or orthotic. It may be that back and buttock pain is reduced after the lift is used, but the muscular imbalance may not be corrected substantially and the feeling of asymmetry remains along with less than optimal movement patterns and athletic performance. Furthermore, the body does not easily accept correcting with a lift equal in height to the leg length difference, even after wearing a lift for several years, Physiotherapists often recommend using a lift height no more than half the leg length difference. Health professionals employ a variety of techniques to reduce muscle imbalances in the body. These involve both strengthening and stretching exercises. Activities such as yoga and Pilates are beneficial. Cycling is also a beneficial activity that has a low impact on the joints and promotes healthy hip function. However, it is possible that cycling will enhance a pre-existing muscle imbalance, instead of reducing it, and may lead to anterior pelvic tilt and lordosis in the spine due to repetitive cycling with a small hip angle and shortened hip flexors.

The state of the art is lacking in techniques for physiotherapy and more particularly in rehabilitative techniques. The present apparatus and method provide improved techniques of physiotherapy and rehabilitation.

SUMMARY

An improved apparatus for physiotherapy includes a lever arm. A biasing device pivotally biases the lever arm about a pivot axis. There is a support configured for supporting the lever arm above an exercise equipment. A harness is configurable on a torso of a user to couple the user to the lever arm. The pivot axis can correspond to an anatomical longitudinal axis of the user and the torso of the user can be biased by the lever arm about the anatomical longitudinal axis.

In exemplary embodiment, the lever arm can include a frame having a yoke section. The yoke section can be an inverted U-shaped structure or a rotated C-shaped structure. The frame can further include a binding section connected with the yoke section. The binding section can be substantially orthogonal to the yoke section. The binding section can be an O-shaped structure, a D-shaped structure, a pair of L-shaped structures arranged like an O-shape, or a pair of I-shaped structures arranged side-by-side. The yoke section can include a base member and a pair of side members extending from the base member at opposite ends thereof, and the binding section can extend between and connect with the pair of side members. The binding section can form a closed path. The binding section can be configured around at least a portion of the torso of the user.

The harness can include at least one of a belt, clothes, a construction harness, a daisy chain loop sling, a first responder harness, a full-body harness, a mountain climbing harness, pants or shorts with belt loops, a strap, a vest-style harness, or a weight-lifting body belt. The harness can further include a coupler that couples the harness to the lever arm. The coupler can be at least one of a band, a belt, a carabiner, a connector, a cord, a fastener, a hook, a latch, a lock, a ring, a rope, a strap, a string, a strip, and VELCRO®. The strap (also known as a connecting strap) can be plastic and substantially not stretchable, or elastic and stretchable. When the lever arm is biased clockwise around the pivot axis, the coupler can extend from the harness towards the lever arm in a clockwise direction around the pivot axis. When the lever arm is biased counter-clockwise around the pivot axis, the coupler can extend from the harness towards the lever arm in a counter-clockwise direction around the pivot axis. The coupler can form an angle less than or equal to 60 degrees with a line of force exerted by the lever arm on the coupler. Preferably, the angle can be less than or equal to 30 degrees. More preferably the angle can be less than or equal to 15 degrees. The exercise equipment can be one of a treadmill, a stationary bicycle, or a step climber. The biasing device can be a spring, an elastic strap, a rubber band, a bungee cord, an electromagnetic biasing device, a solenoid or an electric motor.

In another exemplary embodiment, the lever arm can be a first lever arm, the biasing device can be a first biasing device, the frame can be an outer frame, and the yoke section can be an outer yoke section. The apparatus can further include a second lever arm and a second biasing device pivotally biasing the second lever arm about the pivot axis. The second lever arm can include an inner frame having an inner yoke section. The second lever arm can be rotatable within the outer yoke section. There can be a first binding section connected with the outer yoke section and a second binding section connected with the inner yoke section. The first binding section can be disposed below the second binding section. The harness can be a first harness, and the apparatus can further include a second harness configurable on the torso of the user to couple the user to the second lever arm.

An improved method for physiotherapy includes applying a rotational bias about an anatomical longitudinal axis of a user directly to a torso or a cranium of the user; the user operating an exercise equipment while the rotational bias is applied; and the user actively resisting or passively submitting to the rotational bias at least part of the time while using the exercise equipment.

The rotational bias can be applied to one of a pelvic region, a lumbar spinal region, a thoracic spinal region, an abdomen, a chest, or a trunk of the user. The rotational bias can be clockwise or counter-clockwise about the anatomical longitudinal axis.

An improved method for physiotherapy includes applying a lower rotational bias about an anatomical longitudinal axis of a user directly to a torso of the user; applying an upper rotational bias about the anatomical longitudinal axis of the user directly to the torso of the user; the user operating an exercise equipment while the lower rotational bias and the upper rotational bias are applied; the user actively resisting or passively submitting to the lower rotational bias at least part of the time while using the exercise equipment; and the user actively resisting or passively submitting to the upper rotational bias at least part of the time while using the exercise equipment.

The lower rotational bias can be applied to one of the pelvic region, the lumbar spinal region, or the abdomen of the user. The upper rotational bias can be applied to one of the lumber spinal region, the thoracic spinal region, or the chest of the user. The method can include one of the following configurations: the lower rotational bias can be clockwise and the upper rotational bias can be clockwise about the anatomical longitudinal axis; the lower rotational bias can be clockwise and the upper rotational bias can be counter-clockwise about the anatomical longitudinal axis; the lower rotational bias can be counter-clockwise and the upper rotational bias can be clockwise about the anatomical longitudinal axis; and the lower rotational bias can be counter-clockwise and the upper rotational bias can be counter-clockwise about the anatomical longitudinal axis.

BRIEF DESCRIPTION OF THE DRAWINGS

The accompanying drawings, which are incorporated into and constitute a part of the specification, illustrate specific embodiments of the apparatus, systems, and methods and, together with the general description above, and the detailed description of the specific embodiments, serve to explain the principles of the apparatus, systems, and methods.

DETAILED DESCRIPTION

Figure 1:
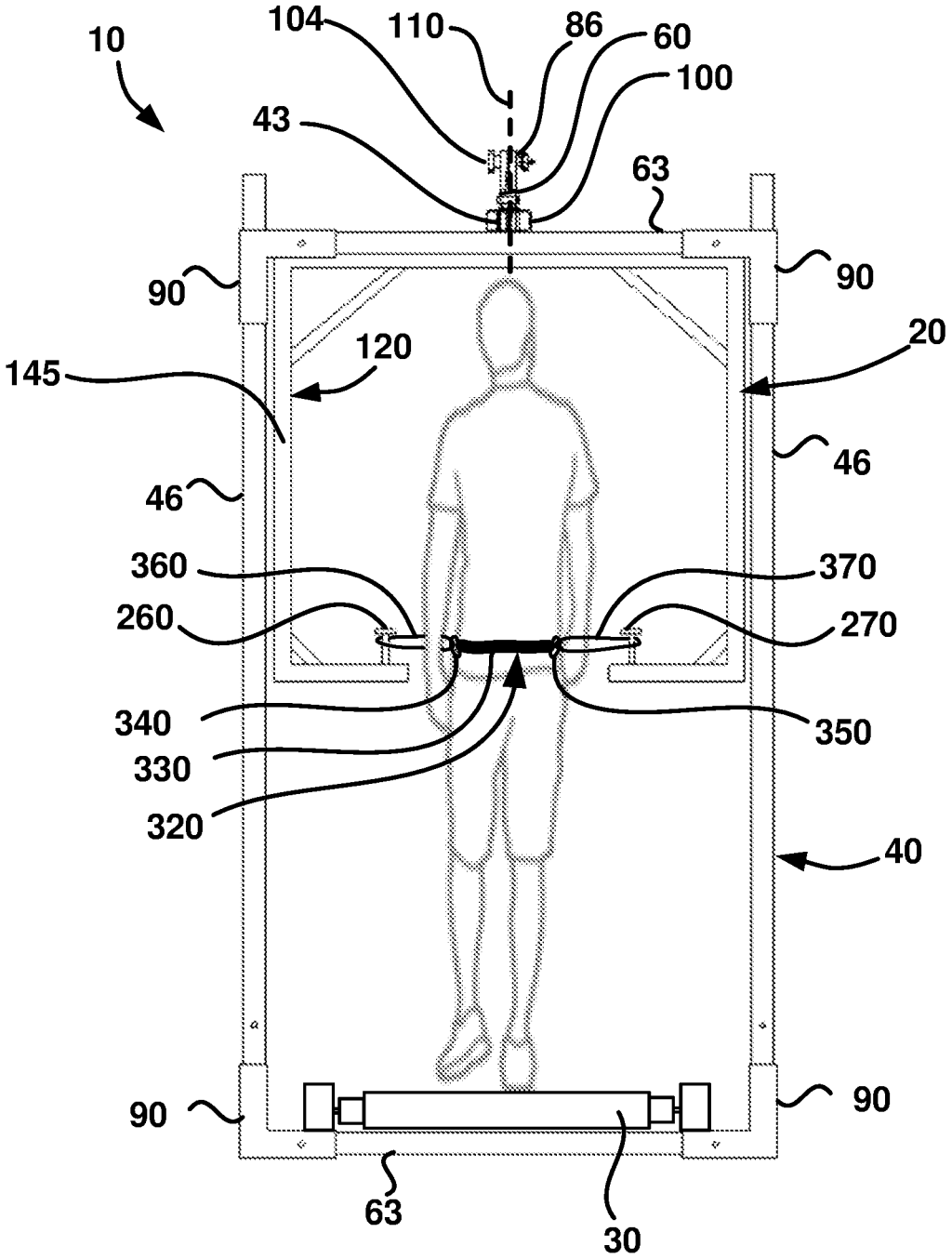
FIG. 1 is a side elevation view of a biased lever-arm according to an embodiment configured with a treadmill and illustrated with a user
Figure 2:
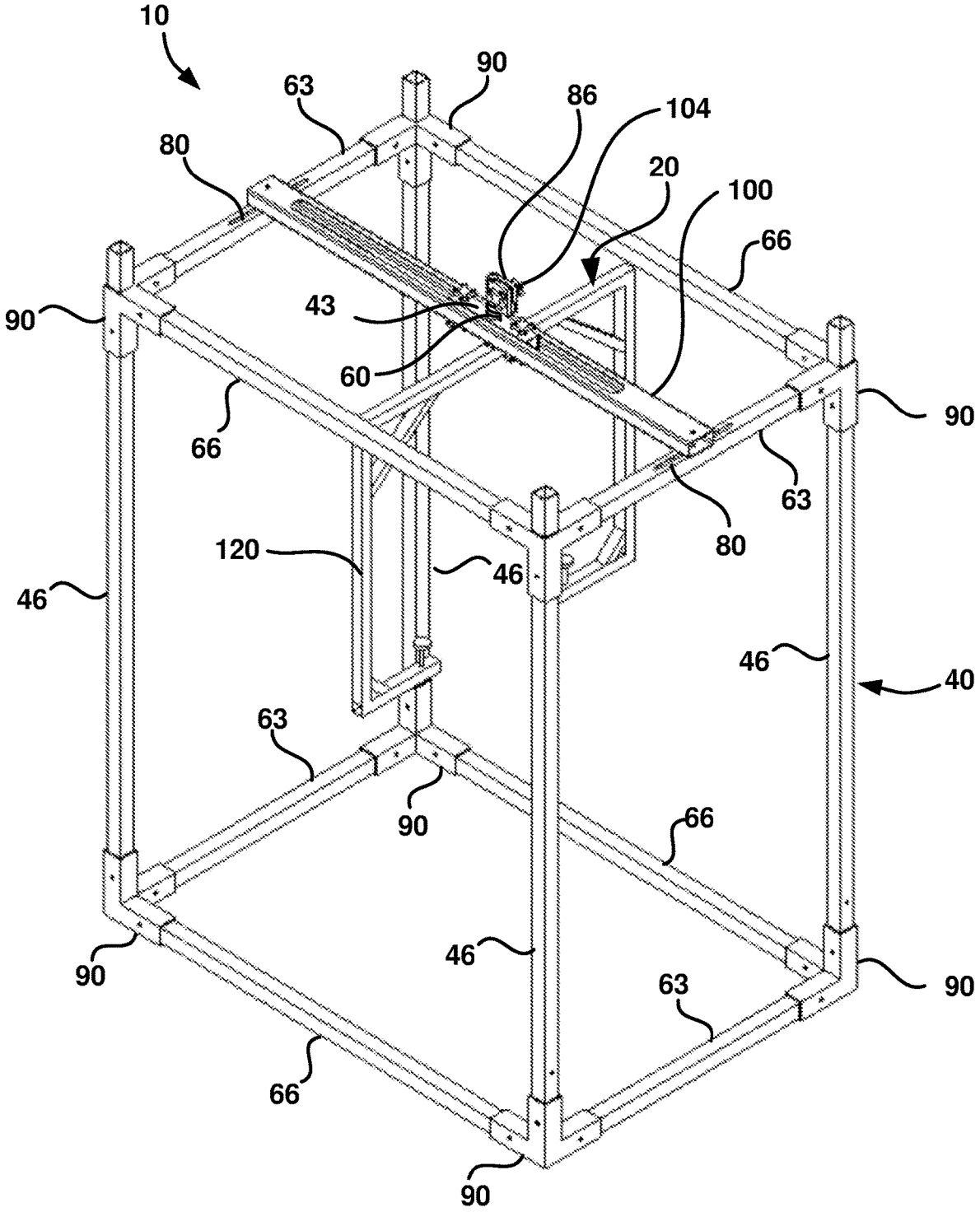
FIG. 2 is a perspective view of the biased lever-arm of FIG. 1.

Referring first to FIGS. 1 and 2 there is shown biased lever-arm 10 (also known as a biased frame apparatus as are all biased lever-arms disclosed herein) including support 40, lever arm 20 and biasing device 60. Support 40 can be in the form of a cage or frame that in the illustrated embodiment includes elongate member 100 that supports lever arm 20. Biased lever-arm 10 can be employed with treadmill 30 or other exercise equipment like a stationary bicycle or a step climber. Treadmill 30 can be any conventional treadmill and in the illustrated embodiment only a walking platform part of the treadmill is shown and a control panel part of the treadmill has been removed for clarity but is a part of the treadmill. Support 40 can provide support for elongate member 100 above the ground or surface upon which biased lever-arm 10 is placed, and more particularly high enough above the ground or surface such that a user can operate biased lever-arm 10 unencumbered from height restrictions while using treadmill 30 as illustrated in FIG. 1, or other exercise equipment. In the illustrated embodiment, support 40 is a structure in the form of a cage including vertical members 46, horizontal members 63 and horizontal members 66 connected with each other at corner joints 90 respectively and secured in place by fasteners, such a nuts and bolts. In other embodiments corner joints 90 are not required and instead vertical members 46 can be secured directly to horizontal members 63 and 66. In still further embodiments support structure 40 does not need to be a cage and instead can be any support that supports elongate member 100, such as a cantilevered-type support. Elongate member 100 can be a tubular member selectively secured along slots 80 (best seen in FIG. 2) in horizontal members 63, for example with fasteners, such as nuts, washers and bolts. Alternatively, instead of slots 80 there can be a single bore in each member 63 or a plurality of bores space apart.

Figure 3:
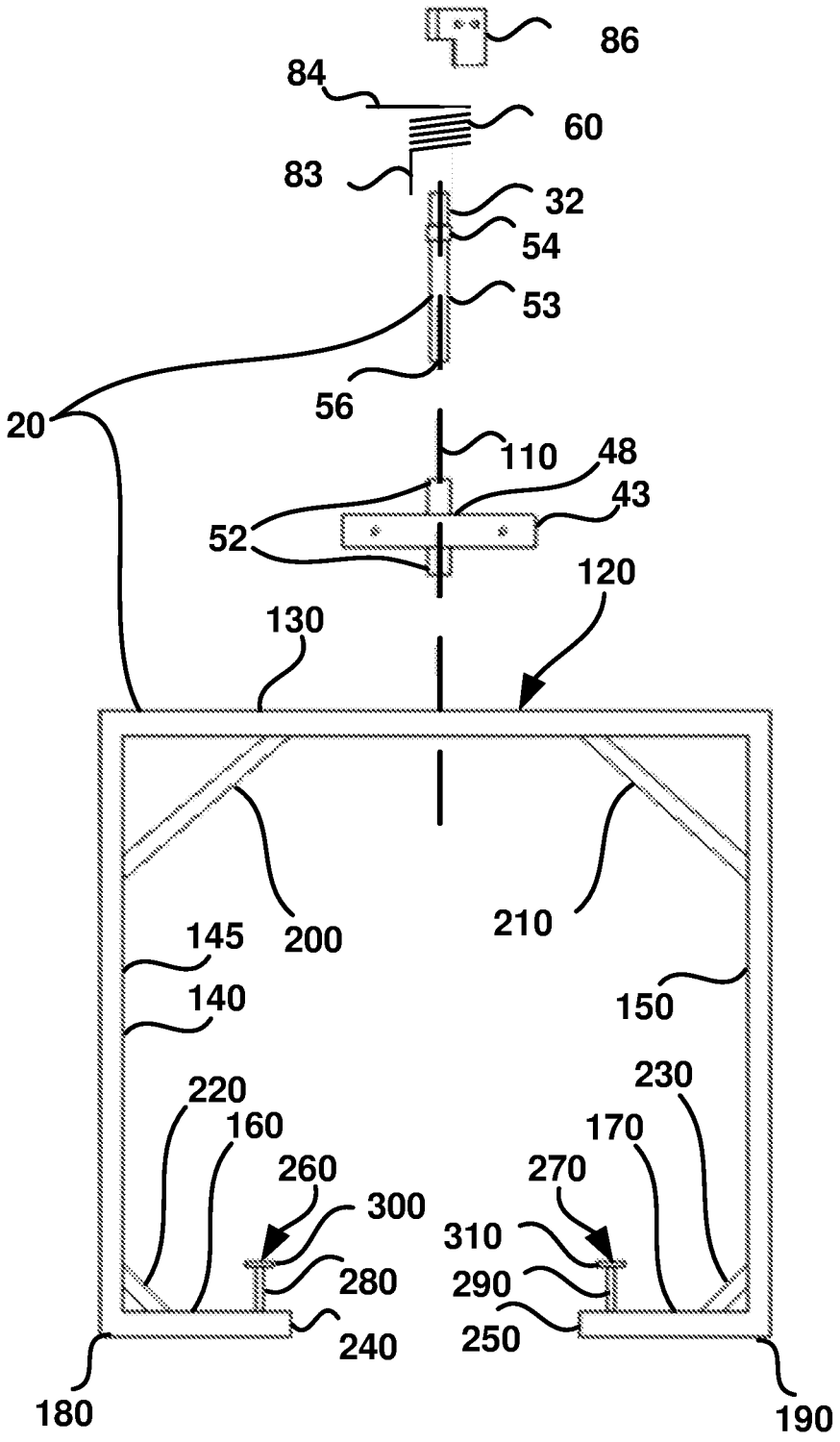
FIG. 3 is an exploded view of a lever arm, a biasing device and a support of the biased lever-arm of FIG. 1.
Figure 4:
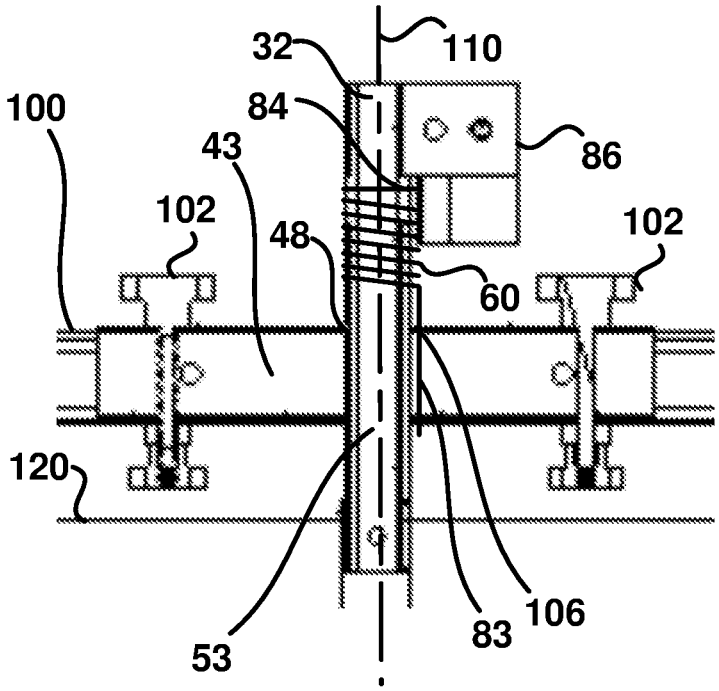
FIG. 4 is a partial detail cross-sectional view of a biasing device, a spring retainer, a lever arm and a support of the biased lever-arm of FIG. 1.

With additional reference to FIGS. 3 and 4, lever arm 20 includes frame 120 connected to cylindrical member 53. Cylindrical member 53 is supported by support member 43 (best seen in FIGS. 3 and 4) that can be slidably adjusted within elongate member 100 (like a piston) and securely retained in place by fasteners 102. Support member 43 can be tubular and can include cylindrical tubular member 52 extending through bore 48 of support member 43. Cylindrical member 53 (best seen in FIG. 3) includes collar 54 and extends through tubular member 52 until collar 54 abuts an end of member 52. End 56 of cylindrical member 53 is secured to frame 120, for example by a weld, a fastener, or a locking pin (not shown). Cylindrical member 53 is rotatable about pivot axis 110 (seen in FIG. 4) within tubular member 52. Pivot axis 110 is a fulcrum of lever arm 20. In the illustrated embodiment, pivot axis 110 is aligned with a longitudinal axis of cylindrical member 53. Biasing device 60 is in the form of a spring, preferably a torsion spring. Spring 60 preferably includes axial leg 83 and radial leg 84. Axial leg 83 extends through bore 106 in support member 43 (seen in FIG. 4) that angularly retains axial leg 83 and prevents the rotation of axial leg 83 around pivot axis 110, and in that regard support member 43 also acts as a spring retainer. Radial leg 84 is retained or secured to cylindrical member 53 by spring retainer 86. Spring 60 can be a right hand wind (RHW) torsion spring or a left hand wind (LHW) torsion spring, and the use of RHW and LHW torsion springs can be alternated by a user. Spring 60 exerts a clockwise bias on frame 120 about pivot axis 110 (when looking down upon frame 120 and biased lever-arm 10 from above), when spring 60 is a RHW torsion spring. Spring 60 exerts a counter-clockwise bias on frame 120 about pivot axis 110 (when looking down upon frame 120 and biased lever-arm 10 from above), when spring 60 is a LHW torsion spring.

Figure 5:
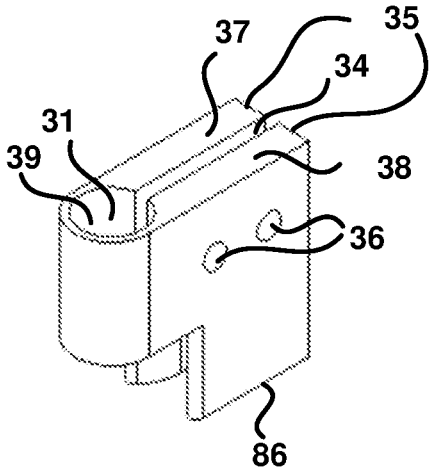
FIG. 5 is a perspective view of a spring retainer of the biased lever-arm of FIG. 3.
Figure 6:
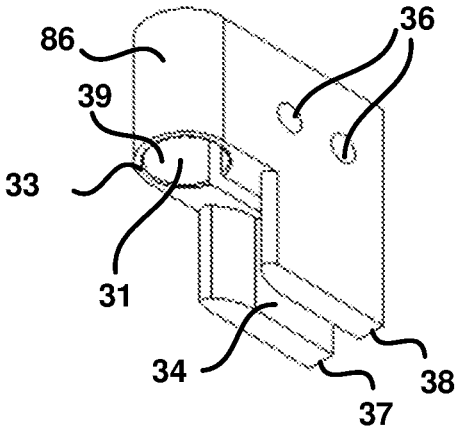
FIG. 6 is a perspective view of a spring retainer of the biased lever-arm of FIG. 3.

Spring retainer 86 can be selectively secured to cylindrical member 53 with fastener 104 (best seen in FIGS. 1 and 2) such that a neutral or unbiased position of lever arm 20 can be set to any angular position around pivot axis 110. Fastener 104 in the illustrated embodiment includes a knob fastener with a rod and a knob fastener with a threaded bore that receives the rod, although in other embodiments other fasteners can be employed, such as nuts and bolts. With reference to FIG. 5, bore 31 having inner surface 39 extends through spring retainer 86 and is received around top section 32 of cylindrical member 53 (best seen in FIGS. 3 and 4). Spring 60 preferably is adjacent to but spaced apart from end 33 of bore 31 when spring retainer 86 is secured to cylindrical member 53 and radial leg 84 extends through slot 34 where it is retained therein during rotation of cylindrical member 53. Slot 34 extends from bore 31 through to end 35 of spring retainer 86. There are two bores 36 through portions 37 and 38 for fasteners 104 of which both or either can be used to squeeze portion 37 towards portion 38 thereby clamping bore 31 around cylindrical member 53. While fastener 104 is loose and not fastening spring retainer 86 to cylindrical member 53, frame 120 can be adjusted to any angular position about pivot axis 110 and then fastener 104 can be tightened to secure spring retainer 86 to cylindrical member 53 and therefore also to retain radial leg 84 to cylindrical member 53. This defines the home position or neutral position of lever arm 20. Any clockwise or counter-clockwise rotation of the frame, depending upon whether spring 60 is a LHW or RHW spring, away from the neutral position would be faced with resistance (that is, a torque or a bias force) to return lever arm 20 to the neutral position.

Frame 120 can also be described as a yoke with yoke arms on either side of a user. With reference to FIG. 3, frame 120 can include yoke section 145 where yoke section 145 and all other yokes sections herein can be described as an inverted U-shaped structure or rotated C-shaped structure. Yoke section 145 includes elongate member 130 extending horizontally and having opposite ends connected with respective elongate members 140 and 150 (the yoke arms) extending substantially vertically downwards and away from elongate member 130. Elongate member 130 can be considered a base member of section 145 and elongate members 140, 150 can be considered respective side members or yoke arms extending from the base member. In general, an inverted U-shaped structure or rotated C-shaped structure like yoke section 145 can be described herein as including a base member and a pair of side members or yoke arms each substantially extending in the same direction from respective ends of the base member. In the illustrated embodiment, section 145 is seen in anatomical frontal plane 1505 (seen in FIG. 42) in FIG. 1 and preferably remains closer to anatomical frontal plane 1505 than anatomical sagittal plane 1500 during operation, as will be described in more detail below, although this is not a requirement. Cylindrical member 53 can be connected with frame 120 near a mid-point of elongate member 130 (the base member of section 145), and preferably at the mid-point, as illustrated in FIGS. 1-3, such that frame 120 is centered about pivot axis 110. It is preferable that other yoke section structures disclosed herein have the mid-point of their base members near or at pivot axis 110, although this is not a requirement and some applications may employ non-mid-point locations to locate pivot axis 110. Yoke section 145 can include elongate members 160, 170 extending horizontally inwards from respective elongate members 140, 150 preferably near respective ends 180, 190 towards each other. Truss members 200, 210, 220 and 230 can be employed to strengthen frame 120. Frame 120 can be an integrated component or assembled from a plurality of components. Near inner ends 240 and 250 of respective horizontal elongate members 160, 170 there can be respective pegs 260 and 270 extending vertically upwards in the illustrated embodiment, although in other embodiments they can also extend vertically downwards or in both directions. Pegs 260 and 270 can also be described as rods 280 and 290 with flanges 300 and 310, which can be, for example, fasteners such as bolts secured to horizontal elongate members 160 and 170 by washers and nuts (not shown).

Figure 17:
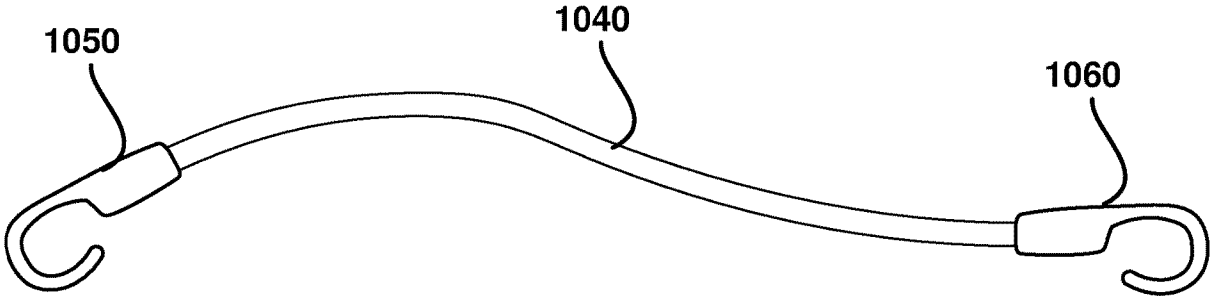
FIG. 17 is a plan view of a strap employed in the biased lever-arm of FIG. 9.

Returning to FIG. 1, biased lever-arm 10 cooperates with harness 320 worn by a user to connect or couple the user with frame 120. Harness 320 can include belt 330, loops 340 and 350 and connecting straps 360 and 370. Connecting straps 360 and 370 operate as couplers to couple the user to lever arm 20. Harness 320 can include and the user can be coupled to lever arm 20 (and all other lever arms disclosed herein) by a variety of couplers (that is, attachment means), such as bands, belts, carabiners, connectors, cords, fasteners, hooks, latches, locks, rings, rope, straps, strings, strips, VELCRO®, etc. can be employed. It is noteworthy that even though the coupler may be connected to lever arm 20 before it is connected with other parts of harness 320, the coupler can still be considered part of harness 320. In an exemplary embodiment loops 340 and 50 are connected to belt 330. In another embodiment, harness 320 can include clothes worn by the user; for example loops 340 and 350 can be belt loops that are present on pants or shorts worn by the user, and belt 330 can be a conventional belt employed to keep the pants and shorts securely on the user. In still further embodiments, harness 320 can include a vest-style harness, a full-body harness, a mountain climbing harness, a first responder harness, a construction harness, or a weight-lifting body belt. Alternatively or additionally, harness 320 can be a strap (such as a nylon strap) with a mail snap-fit connector at one end and a corresponding female connector at the opposite end that can be wrapped around the user once or a plurality of times to ensure a snug and secure fit. In some embodiments a daisy chain loop sling (not shown), employed in rock or mountain climbing, can be part of harness 320, where the daisy chain loop sling includes a strap or belt that can be wrapped around a user and with a plurality of loops fixed along the length of the strap that are convenient to connect other straps (such as connecting straps 360 and 370) thereto. The daisy chain loop sling can be employed with the types of harnesses 320 disclosed herein. Each connecting strap 360 and 370 can be a strap (such as a nylon strap) with mutually engageable male and female connectors (not shown) that mutually engage each other (for example by snap-fitting) and that allow the strap to be adjusted for length. More preferably, connecting straps 360 and 370 are flexible, elastic straps that allow for elongation, such as a bungee cord (e.g. seen in FIG. 17) or a rubber band, and these straps can include hook connectors at either end to easily secure the bungee cord to pegs 260 and 270 or to holes or bores in lower horizontal elongate members 160 and 170 (in which case pegs 260 and 270 are not required). It is noteworthy that either connecting strap 360 or 370 can be employed singularly to connect the user with biased lever-arm 10, or more preferably they can be employed together to connect the user with biased lever-arm 10. Connecting straps 360 and 370 connect harness 320 worn by the user to frame 120. When connecting straps 360 and 370 are flexible, the user can wobble to a greater degree around pivot axis 110 of lever arm 20 while walking compared to when connecting straps 360 and 370 are plastic or rigid, which can allow the user to have a more natural gait when using the flexible straps. In the illustrated embodiment, harness 320 can be worn around a torso (or a trunk) of the user. Three particular regions of the torso where harness 320 can be connected with are a pelvic region, a lumbar spinal region, and a thoracic spinal region. In an exemplary embodiment harness 320 can be worn around a waist of the user by a pelvis, and preferably near respective iliac crests, iliac spine or the anterior superior iliac spine, thereby securing the pelvis to frame 120. In another embodiment harness 320 can be worn around an abdomen of the user around the lumbar spine. In another embodiment harness 320 can be worn around a chest of the user around the thoracic spine. Harness 320 can theoretically also be worn around the cranium of the user. There are safety implications that need to be considered when the harness is worn around the cranium of the user that is beyond the scope of this disclosure, and these safety implications particularly concern employing biased lever-arm 10 with treadmill 30 (where the user can be moved away from harness 320 by treadmill 30, for example if the user stumbles) in contrast to employing biased lever-arm 10 with a stationary bicycle and a step climber where the user's position substantially remains static. Breakaway connections (not shown) can be employed between harness 320 and lever arm 10 that will disconnect when forces becomes too great for the breakaway connections but not enough to harm the user. Another safety measure can include a physiotherapist or a technician monitoring the user with harness 320 around their cranium operate the exercise equipment such that the physiotherapist or the technician can intervene when an unsafe situation arises to maintain the safety of the user.

Elongate members 140, 150 (seen in FIG. 3) can be telescoping such that lower elongate members 160, 170 can be brought into the vicinity of the pelvis, the lumbar spine, the thoracic spine, or the cranium. Alternatively, in other embodiments lower elongate members 160, 170 can be L-shaped and secured by fasteners to two or more locations along elongate members 140, 150, respectively.

In operation, spring 60 exerts an angular bias on lever arm 20 such that when the user walks or runs on treadmill 30, either forwards or backwards, lever arm 20 exerts a tangential and an angular bias (that is, a torque) on the user, and more specifically to the region of the torso of the user where harness 320 is secured, such as the pelvic region, the lumbar spinal region, and the thoracic spinal region. This angular bias exerted on the user during gait counteracts compensations that occur in the human body due to, for example, leg length differences or other abnormalities, and overtime by repetitive use these compensations can be reduced. Athletic performance and a general sense of wellbeing may improve when the human body is more in alignment and symmetrical. Although biased lever-arm 10 is illustrated with treadmill 30, in other embodiments biased lever-arm 10 can be employed with a stationary bicycle, a step climber, or other types of conventional exercise equipment. In other embodiments biased lever-arm 10 can be supported by support structures other than support structure 40, such as a cantilevered support structure.

Figure 7:
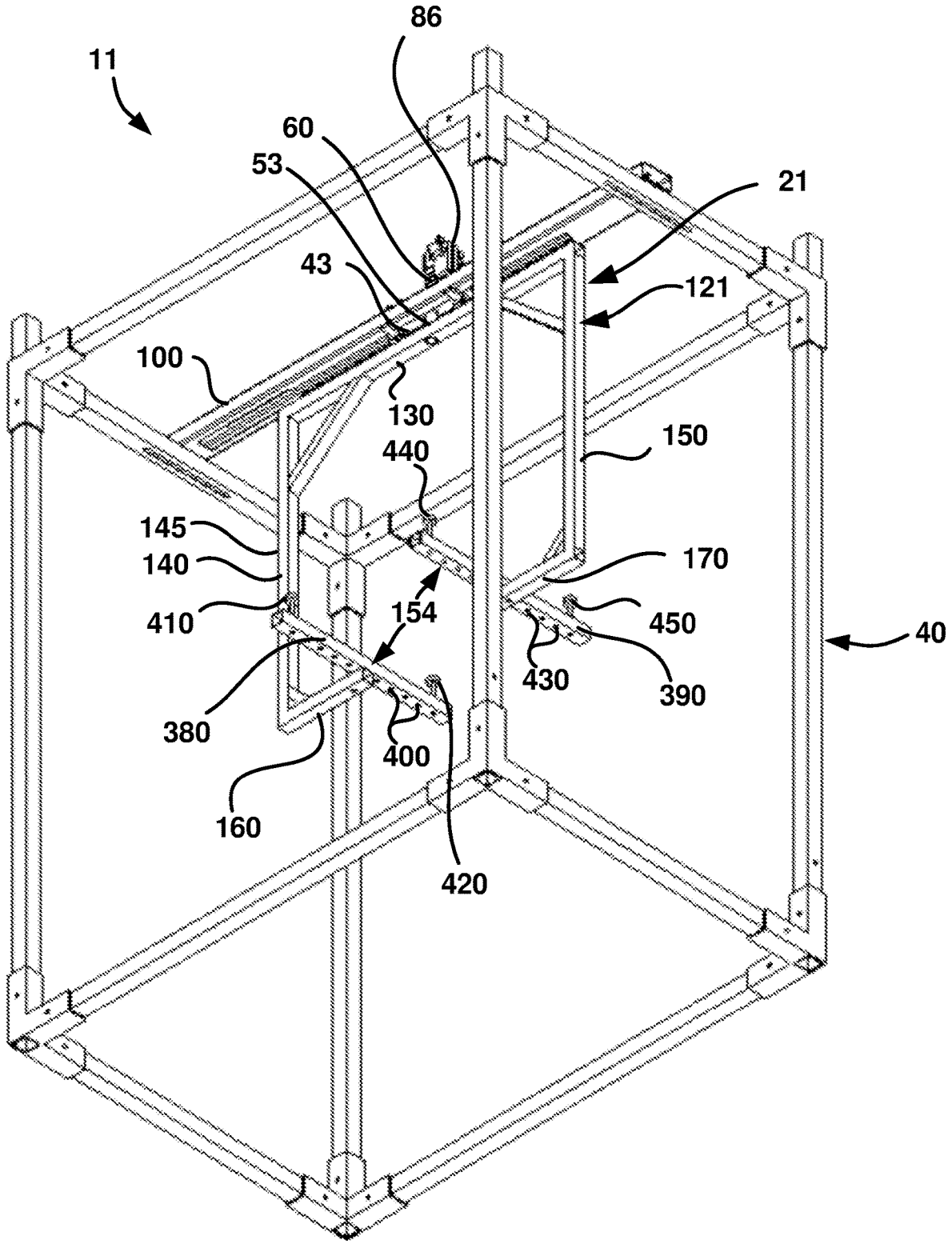
FIG. 7 is a perspective view of a biased lever-arm according to another embodiment.
Figure 45:
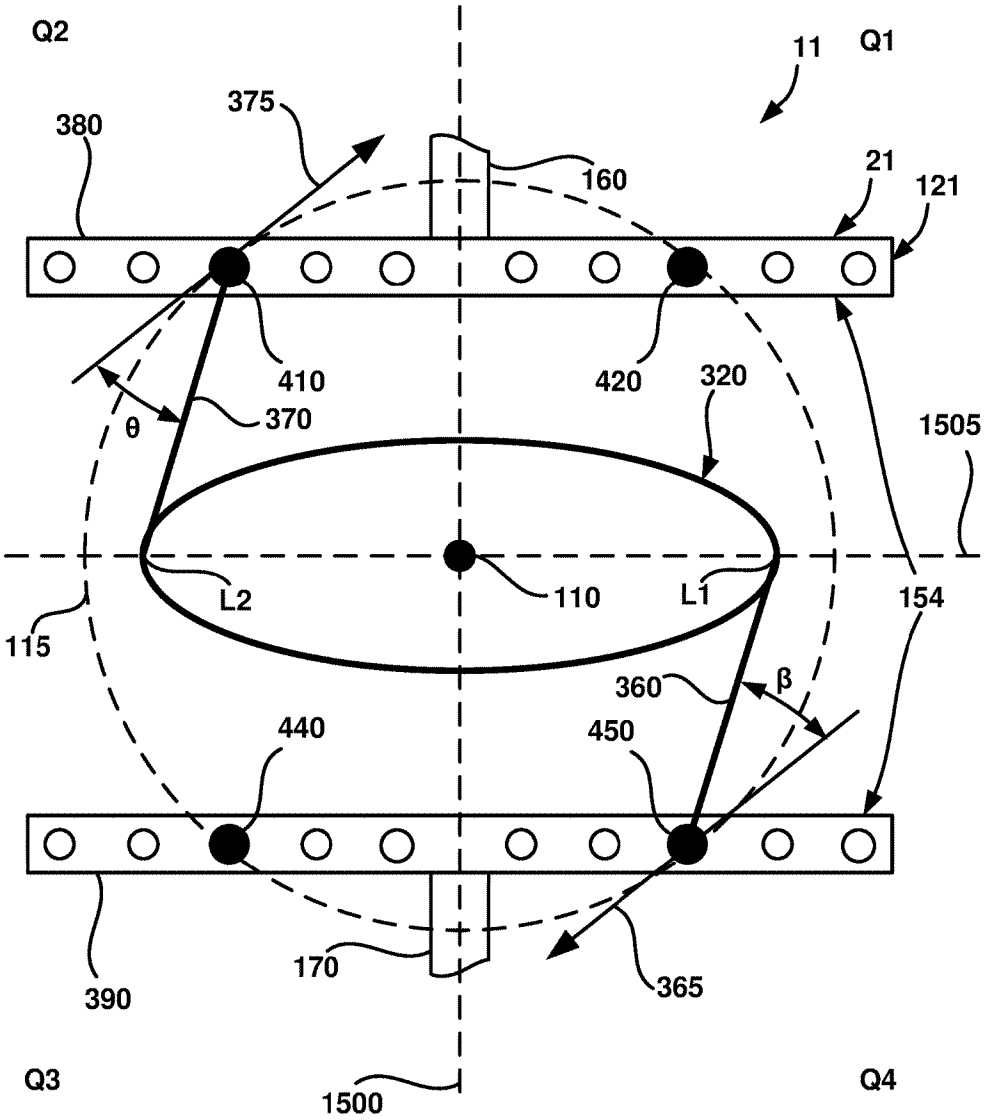
FIG. 45 is a top plan view of a binding section of the biased lever-arm of FIG. 7 illustrating bindings between connecting straps of a harness and the binding section.

Referring now to FIG. 7, there is shown biased lever-arm 11 according to another embodiment where like parts to the previous embodiment and all other embodiments have like reference numerals, and may not be discussed in further detail, and at least differences are discussed. Biased lever-arm 11 includes support 40, lever arm 21 and biasing device 60. Lever arm 21 includes frame 121 and cylindrical member 53. Frame 121 includes binding section 154 that includes elongate members 380 and 390 substantially extending horizontally and perpendicularly to elongate members 160 and 170, and connected thereto, respectively, such as by welds or fasteners. Note that elongate members 160 and 170 can be telescoping such that a distance between elongate members 380 and 390 can be adjusted. Alternatively, elongate members 380 and 390 can be fastened to elongate members 160 and 170, respectively at a plurality of locations to allow adjustment of the distance between elongate members 380 and 390. Binding section 154 can be described as a pair of I-shaped structures arranged side-by-side, each connected with one of the side members 140, 150 of yoke section 145. In one example, members 160 and 380 can be behind the user and members 170 and 390 can be in front of the user (who is not shown in the illustrated embodiment). Elongate member 380 can have a plurality of holes 400 and pegs 410 and 420. Pegs 410 and 420 can be connected with or fastened to any of the holes 400. In an exemplary embodiment, peg 410 can be connected to one of the holes 400 to the right side of lower horizontal elongate member 160 (from the user's perspective noting member 160 is behind the user, preferably) and peg 420 is connected to one of the holes 400 to the left side of member 160. In the illustrated embodiment, yoke section 145 is seen in anatomical sagittal plane 1500 (seen in FIG. 42) in FIG. 7 and preferably remains closer to anatomical sagittal plane 1500 than anatomical frontal plane 1505 during operation; however, this is not a requirement. Elongate member 390 can have a plurality of holes 430 and pegs 440 and 450. Pegs 440 and 450 can be connected with or fastened to any of the holes 430. In an exemplary embodiment, peg 440 can be connected to one of the holes 430 to the right side (from the user's perspective) of lower horizontal elongate member 170 and peg 450 can be connected to one of the holes 430 to the left side of member 170. In other embodiments, pegs 410, 420, 440, and 450 are not required, and connecting strap 360 can be connected directly connected with any one of holes 400 and 430, and connecting strap 370 can be connected directly connected with any one of holes 400 and 430, as will now be described in more detail. With reference to FIG. 1, note that connecting strap 360 is the strap on the user's left side and connecting strap 370 is the strap on the user's right side. Preferably, when connecting strap 360 is connected with peg 450 or one of the plurality of holes 430, in front and to the left of the user, then connecting strap 370 is connected with peg 410 or one of the plurality of holes 400, behind and to the right of the user, and frame 121 can be biased in a clockwise direction (when looking down from above the user); and when connecting strap 360 is connected with peg 420 or one of the plurality of holes 400, behind and to the left of the user, then connecting strap 370 is connected with peg 440 or one of the plurality of holes 430, in front and to the right of the user, and frame 121 can be biased in a counterclockwise direction (when looking down from above the user). In the illustrated embodiment of FIG. 7, connecting straps 360 and 370 are connected with the user more along the lines of force exerted by frame 121 on the straps compared to how the straps are connected in biased frame apparatus 10 in FIG. 1, where the straps are connected more orthogonally to the lines of force exerted by frame 120. For example, with reference to FIG. 45, a configuration of harness 320 with lever arm 21 is illustrated to describe the relationship between connecting straps 360 and 370 and the lines of force generated by biased lever-arm 11. Note that lever arm 21 is biased clockwise around pivot axis 110 and circular path 115 represents the path followed by pegs 410, 420, 430, and 440 as lever arm 21 rotates about pivot axis 110. First angle β between connecting strap 360 and first line of force 365 exerted by elongate member 390 of binding section 154 (of frame 121 of lever arm 21) on connecting strap 360 can be less than or equal to 60 degrees, and preferably less than or equal to 30 degrees, and more preferably less than or equal to 15 degrees. First line of force 365 is tangential to circular path 115 at peg 450. Similarly, second angle θ between strap 370 and second line of force 375 exerted by elongate member 380 of binding section 154 (of frame 121 of lever arm 21) on connecting strap 370 can be less than or equal to 60 degrees, and preferably less than or equal to 30 degrees, and more preferably less than or equal to 15 degrees. Second line of force 375 is tangential to circular path 115 at peg 410. The first angle can vary depending upon where strap 360 is connected to harness 320 and to binding section 154. Similarly, the second angle can vary depending upon where strap 370 is connected to harness 320 and to binding section 154. First angle β and second angle θ can apply to whatever the attachment means is employed to couple the user to lever arm 11. For example, in some embodiments one or more of the attachment means previously disclosed can be employed instead of or in addition to straps 360 and 370, and the same principle is applied to define the relationship (first angle β and/or second angle θ) between the attachment means and the lines of force 365 and 375. The relationship between strap 370 and first line of force 375 defined by first angle β can apply to all embodiments of biased lever-arms herein except for biased lever-arm 10 of FIG. 1. Similarly, the relationship between strap 360 and second line of force 365 defined by second angle θ can apply to all embodiments of biased lever-arms herein except for biased lever-arm 10 of FIG. 1. It is noteworthy that either connecting strap 360 or 370 can be employed singularly to connect the user with biased lever-arm 11, or they can be employed together to connect the user with biased lever-arm 11. Although connecting straps 360 and 370 can be fixed to harness 320 on the left and right side of the user as shown in FIGS. 1 and 45, they do not need to be directly fixed at the most lateral sides of the user which is defined as the furthest distances of harness 320 on the user along anatomical frontal plane 1505 away from anatomical sagittal plane 1500 in both directions, labeled as points L1 and L2 in FIG. 45. Generally, an effectiveness of connecting straps 360 and 370 improves as first and second angles β and θ, respectively, decrease. However, the user can connect straps 360 and 370 to lever arm 21 in a variety of ways. When lever arm 21 is biased clockwise (when looking down from above), connecting straps 360 and 370 can extend from harness 320 and connect to binding section 154 in a clockwise manner. It's possible that either connecting strap 360 or 370 can be fixed anywhere on harness 320, and as long as connecting strap 360 or 370 extends towards binding section 154 in a clockwise direction and connects anywhere with binding section 154 that could be an effective connection between connecting strap 360 or 370 and binding section 154 when lever arm 21 is biased clockwise. In an exemplary embodiment, connecting strap 360 extends from harness 320 in quadrant Q1 or Q4 in a clockwise direction with regard to pivot axis 110 and connects with elongate member 390, and connecting strap 370 extends from harness 320 in quadrant Q2 or Q3 in a clockwise direction with regard to pivot axis 110 and connects with elongate member 380 when lever arm 21 is biased clockwise. Similarly, when lever arm 21 is biased counter-clockwise (when looking down from above), connecting straps 360 and 370 can extend from harness 320 and connect to binding section 154 in a counter clockwise manner. It's possible that either connecting strap 360 or 370 can be fixed anywhere on harness 320, and as long as connecting strap 360 or 370 extends towards binding section 154 in a counter-clockwise direction and connects anywhere with binding section 154 that could be an effective connection between connecting strap 360 or 370 and binding section 154 when lever arm 21 is biased counter-clockwise. In an exemplary embodiment, connecting strap 360 extends from harness 320 in quadrant Q1 or Q4 in a counter-clockwise direction with regard to pivot axis 110 and connects with elongate member 380, and connecting strap 370 extends from harness 320 in quadrant Q2 or Q3 in a counter-clockwise direction with regard to pivot axis 110 and connects with elongate member 390 when lever arm 21 is biased counter-clockwise. It is noteworthy that connecting straps 360 or 370 (and other types of couplers that can bend) when extending in a clockwise manner or a counter-clockwise manner can extend in a linear and/or a non-linear path. For example, in FIG. 45 connecting straps 360 and 370 are shown to extend from harness 320 in a linear path in a clockwise direction around pivot axis 110. These instructions for configuring connecting straps 360 and/or 370 with harness 320 (or other connecting straps and harnesses discussed below) can apply to any embodiment herein. With regard to biased lever-arm 10 seen in FIGS. 1 and 2, when yoke section 145 is substantially aligned with anatomical sagittal plane 1500 while the user is performing on the exercise equipment (for example, walking or running on treadmill 30), then these instructions for configuring connecting straps 360 and/or 370 with harness 320 can apply. However, when yoke section 145 of biased lever-arm 10 is substantially aligned with anatomical frontal plane 1505 while the user is performing on the exercise equipment (for example, walking or running on treadmill 30), then the first and second angle β and θ, respectively are typically greater than 60 degrees and the goal of reducing the first and second angle β and θ, respectively below 60 degrees does not apply.

Figure 8:
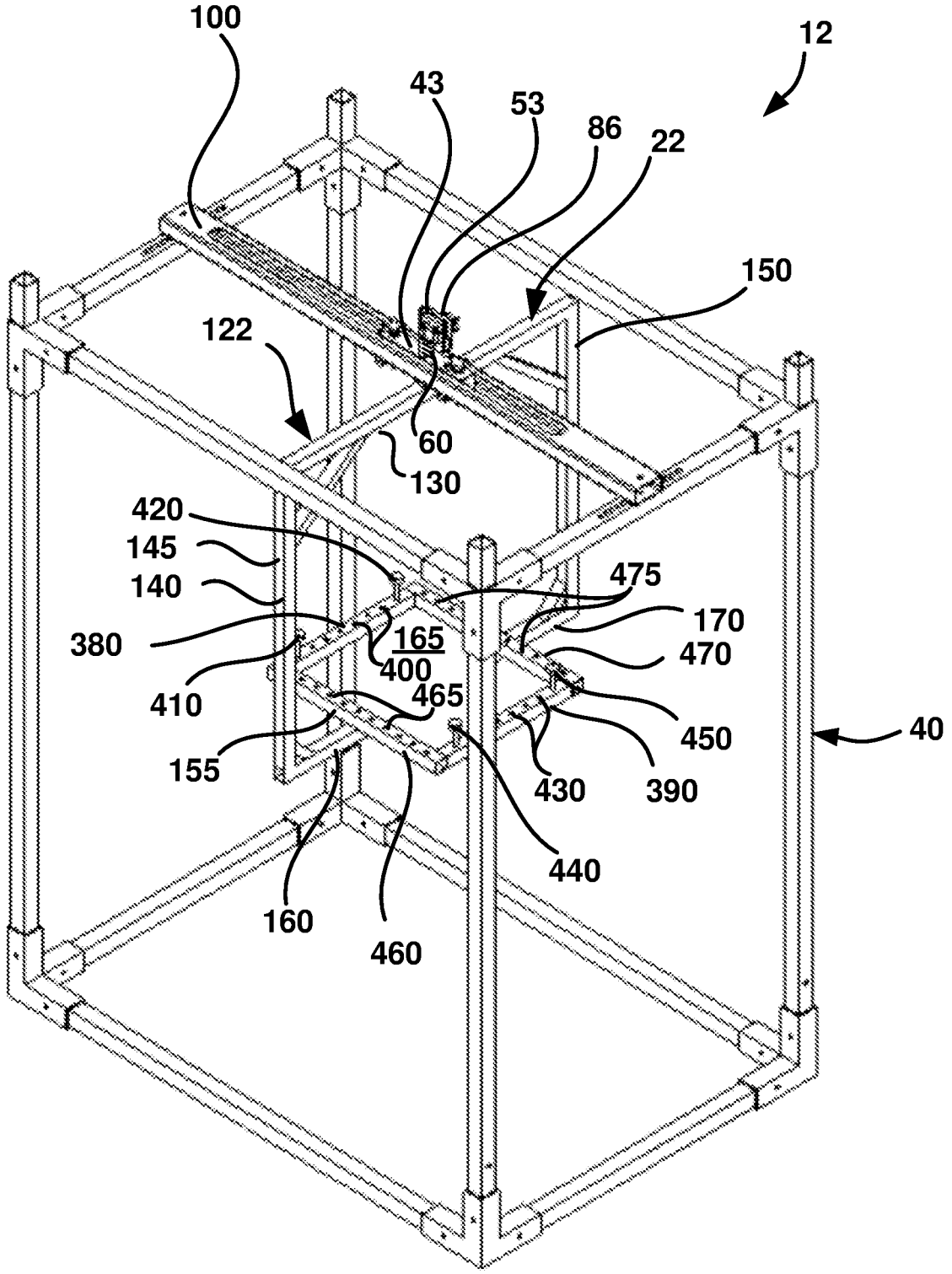
FIG. 8 is a perspective view of a biased lever-arm according to another embodiment.

Referring now to FIG. 8, there is shown biased lever-arm 12 according to another embodiment and at least differences are discussed. Biased lever-arm 12 includes support 40, lever arm 22 and biasing device 60. Lever arm 22 includes frame 122 and cylindrical member 53. Frame 122 includes yoke section 145 and binding section 155. Binding section 155 (and binding sections 630 and 650 discussed in other embodiments below) can be described as an O-shaped structure or a D-shaped structure that can form a closed path in the illustrated embodiment, although they are not required to be closed paths in other embodiments. For example, in other embodiments binding section 155 can include two L-shaped sections arranged in the shape of an O or a D but not forming a closed path where respective L-shaped sections are connected to opposite arms (elongate members 140 and 150) of yoke section 145. Binding section 155 is employed to bind to a user, as will be described in more detail below; accordingly binding section 155 is referred to as a binding section herein. Binding section 155 surrounds interior or user space 165 and is a rectangular-shaped or a boxed-in-shaped in the illustrated embodiment. In other embodiments binding section 155 (and other binding sections disclosed herein) can have a polygon shape, a circular shape, an elliptical shape, or a generalized shape including one or more straight sections and/or one or more curved sections. Yoke section 145 is similar to that described in frames 120 and 121. In the illustrated embodiment, elongate members 160, 170, 460, and 470 can be disposed generally at the sides of a user, for example, elongate members 160 and 460 can be on the right side of the user, and elongate members 170 and 470 can be on the left side of the user, whereby yoke section 145 is seen in anatomical frontal plane 1505 (seen in FIG. 42) in FIG. 8 and preferably remains closer to anatomical frontal plane 1505 than anatomical sagittal plane 1500 during operation; however, this is not a requirement. Binding section 155 can include elongate member 460 substantially extending horizontally and perpendicularly to elongate member 160, and connected thereto, and elongate member 470 substantially extending horizontally and perpendicularly to elongate members 170, and connected thereto. Elongate member 380 can be connected to an end of elongate member 460 at one end and to an end of elongate member 470 at an opposite end. Elongate member 390 can be connected to an end of elongate member 460 at one end and to an end of elongate member 470 at an opposite end. Elongate members 460 and 470 can be telescoping such that the distance between elongate members 380 and 390 can be adjusted. Alternatively, elongate members 380 and 390 can be fastened to elongate members 460 and 470, respectively at a plurality of locations to allow adjustment of the distance between elongate members 380 and 390. In the illustrated embodiment, elongate member 460 can be on the user's right side, elongate member 390 can be in front of the user, elongate member 470 can be on the user's left side, and elongate member 380 can be behind the user. However, the orientation of the elongate members of binding section 155 and the user depends upon whether the user is walking forwards or backwards on treadmill 30, which is also true for all biased lever arms disclosed herein. Preferably, elongate members 380 and 390 are at the same height. Elongate members 380, 390, 460, and 470 can form a closed path or perimeter around the user, which can also be referred to as a boxed-in shape since it boxes the user in.

Preferably, connecting straps 360 and 370 are connected with pegs 410, 420, 440, and 450, and/or with bores 400 and 430 in elongate members 380 and 390, respectively similarly to how they are connected in biased lever-arm 11 in FIG. 7 and/or with bores 465 and 475 in elongate members 460 and 470, respectively. It is noteworthy that either connecting strap 360 or 370 can be employed singularly to connect the user with biased lever-arm 12, or they can both be employed to connect the user with biased lever-arm 12. In other embodiments, yoke section 145 can remain closer to the anatomical sagittal plane 1500 during operation and straps 360 and 370 can be connected with pegs or holes in elongate members 460 and 470 (that is, similarly to biased lever-arm 11 in FIG. 7).

Figure 9:
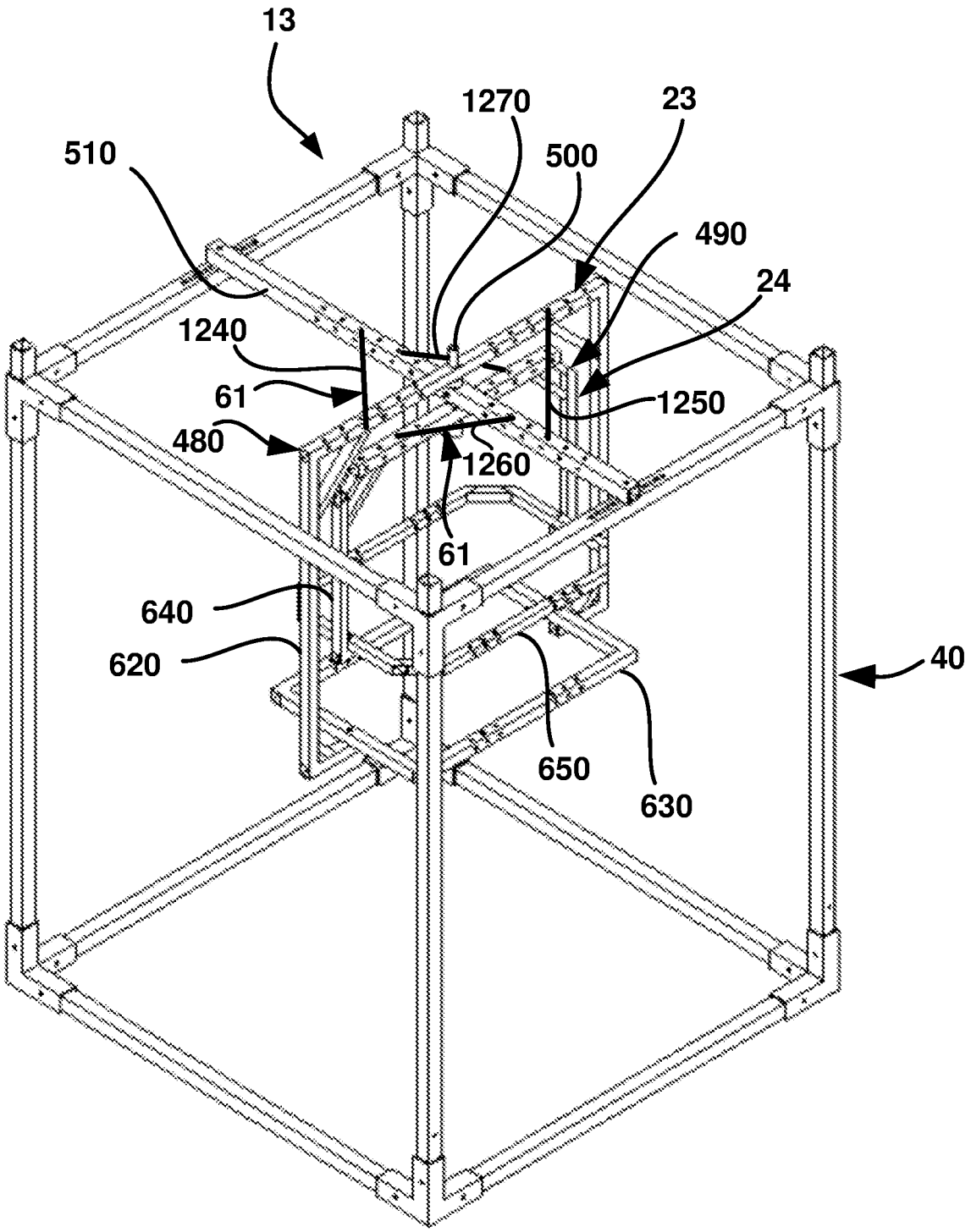
FIG. 9 is a perspective view of a biased lever-arm according to another embodiment.
Figure 13:
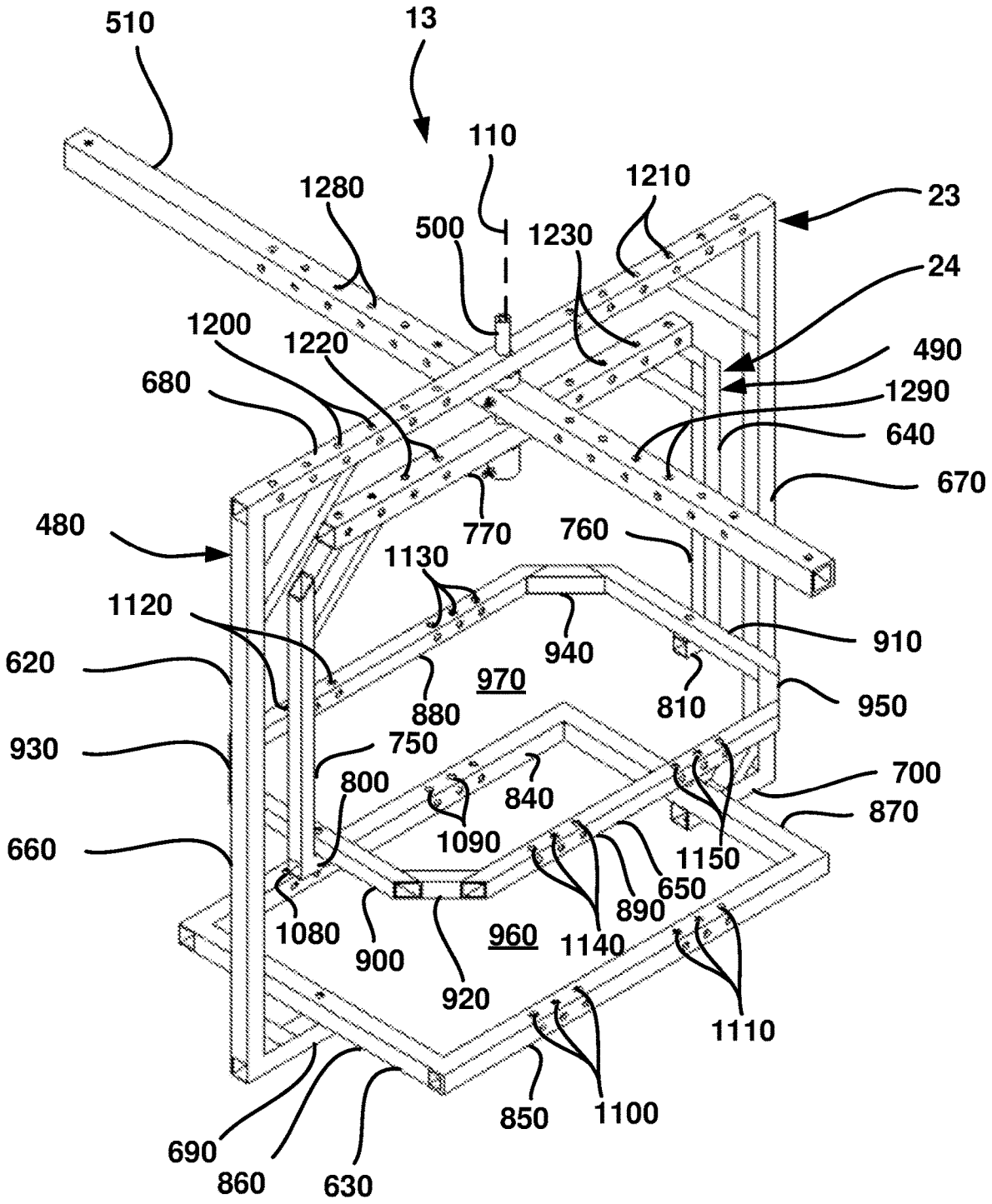
FIG. 13 is a perspective view of the biased lever-arm of FIG. 9 shown without a support structure.
Figure 14:
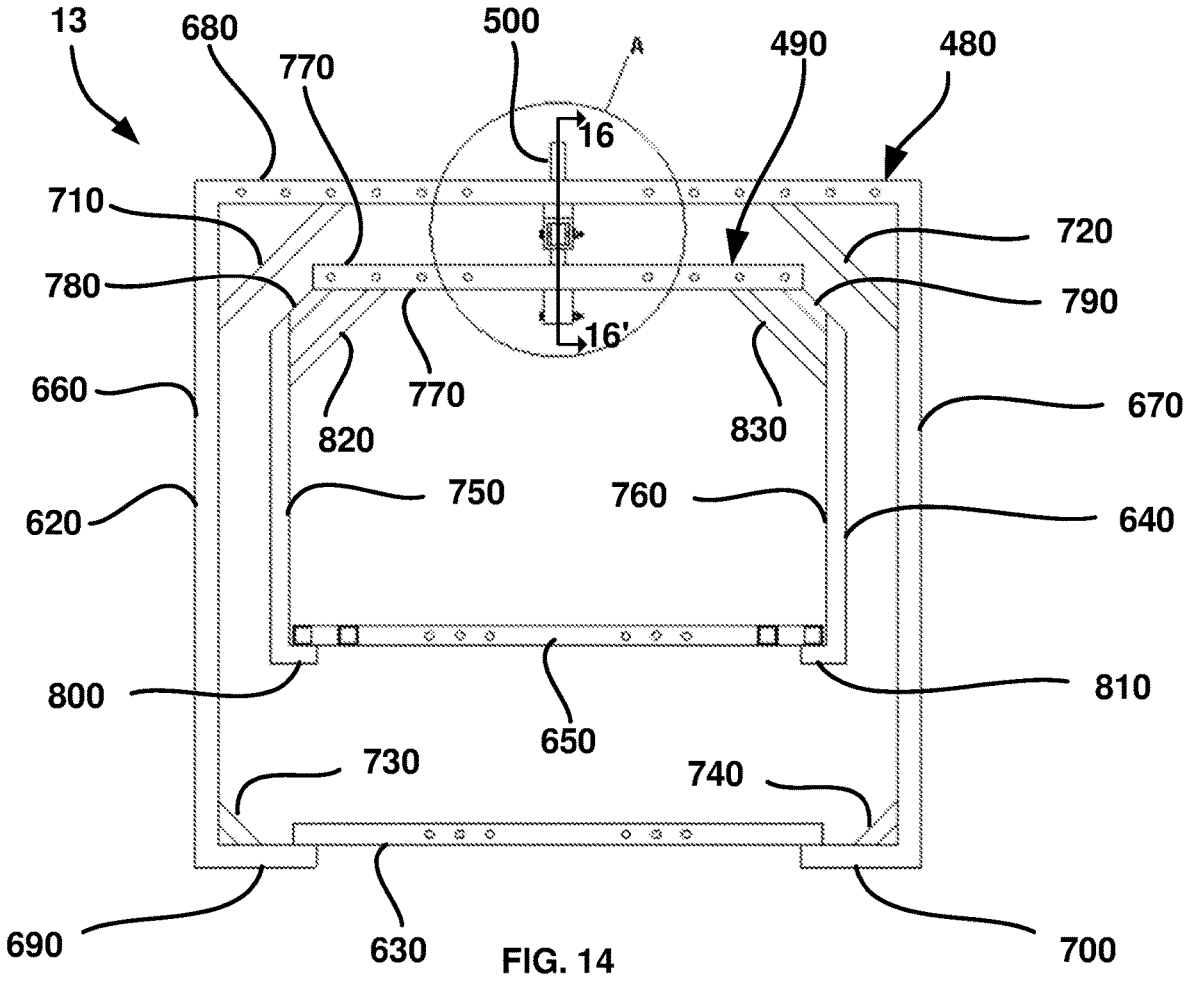
FIG. 14 is a side elevational view of a portion of the biased lever-arm of FIG. 13.
Figure 15:
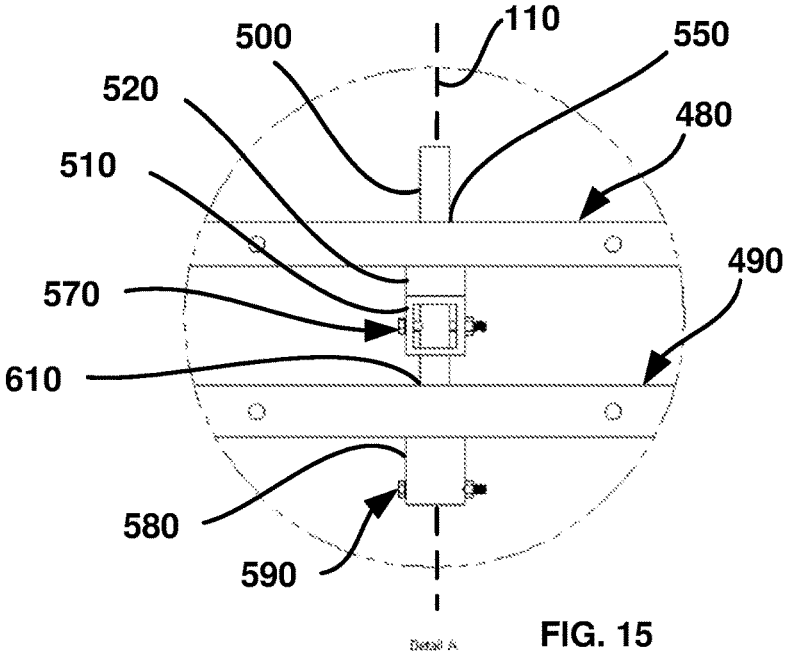
FIG. 15 is a detailed view of a portion of the biased lever-arm of FIG. 14 within circle A.
Figure 16:
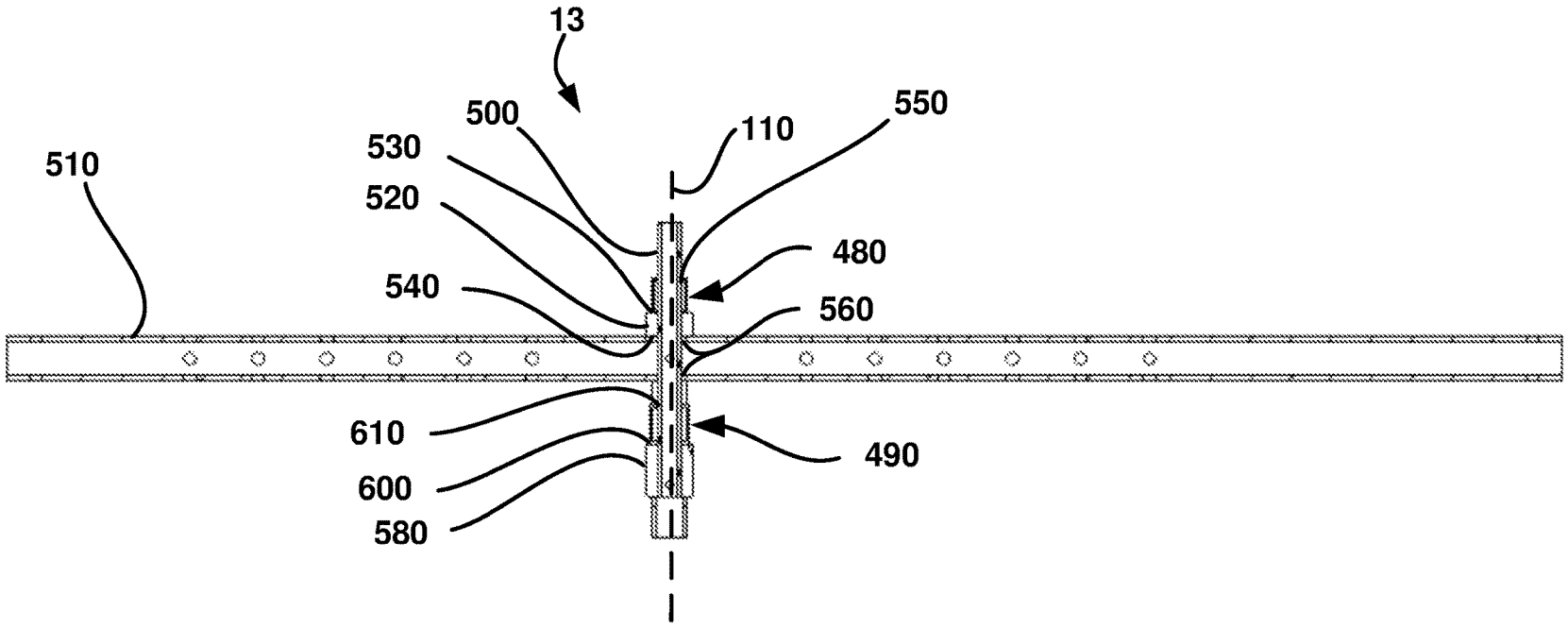
FIG. 16 is a cross-sectional view of a portion of the biased lever-arm of FIG. 14 taken along line 16-16'.

Referring now to FIGS. 9 to 17 and first to FIG. 9, there is shown biased lever-arm 13 according to another embodiment. In the illustrated embodiment, biased lever-arm 13 includes support 40, lever arm 23, lever arm 24 and biasing devices 61. Lever arm 23 includes outer frame 480, and lever arm 24 includes inner frame 490, where the terms outer and inner describe the position of the frames with respect to each other. In other embodiments biased lever-arm 13 can be supported by other support structures, such as a cantilevered support structure. Outer frame 480 and inner frame 490 can pivot or rotate around pivot axis 110 (best seen in FIG. 10) that corresponds to a longitudinal axis of cylindrical member 500, independently and separately from each other. Pivot axis 110 aligns with the longitudinal axis of cylindrical member 500. Inner member 490 rotates within outer member 480, that is outer member 480 is outer with respect to inner member 490, and inner member 490 is inner with respect to outer member 480. Cylindrical member 500, which can be a round tubular member, is supported by elongate support 510. With reference to FIGS. 15 and 16, annular flange 520 extends around cylindrical member 500 and can be secured thereto, and includes surface 530 that supports outer frame 480, and further includes surface 540 that rests on elongate support 510. Annular flange 520 can be secured to cylindrical member 500 by a weld, a press fit, an interference fit, a locking pin, or by fasteners for example. Annular flange 520 serves as a bearing surface for outer frame 480 to take the wear of outer frame 480 pivoting about pivot axis 110, as will be described in more detail below. In other embodiments outer frame 480 can rest on elongate support 510. Cylindrical member 500 extends through bore 550 in outer frame 480 and through bore 560 in elongate support 510. In the illustrated embodiment, fastener 570 can include a bolt, a washer, a lock washer, and a nut that operate as an anti-rotation locking pin that prevents cylindrical member 500 rotating in bore 560 of elongate support 510. Fastener 570 is beneficial when cylindrical member 500 (or annular flange 520) is an incompatible metal compared to elongate support 510, such that they cannot be welded together, and in other embodiments when they are compatible metals they can be welded together such that fastener 570 is not required. Annular flange 580 extends around cylindrical member 500 and can be secured thereto by fastener 590 (that can be like fastener 570 and include a bolt, a washer, a lock washer, and a nut) in the illustrated embodiment, for ease of disassembly, and includes surface 600 that supports inner frame 490. In other embodiments annular flange 580 can be secured to cylindrical member 500 by a weld, a press fit, or interference fit for example. Cylindrical member 500 extends through bore 610 in inner frame 490. It is possible that in other embodiments either annular flange 520 or annular flange 580 can be integrated with cylindrical member 500. Note that outer frame 480 and inner frame 490 are able to rotate about pivot axis 110. In still further embodiments, only one of lever arm 23 or lever arm 24 can be employed.

With reference to FIGS. 13 and 14 outer frame 480 and inner frame 490 are described in more detail. Outer frame 480 includes yoke section 620 supporting binding section 630, and inner frame 490 includes yoke section 640 supporting binding section 650. Binding section 630 of outer frame 480 is disposed below binding section 650 of inner frame 490. Preferably, yoke sections 620 and 640 are substantially perpendicular to binding sections 630 and 650, respectively. Yoke section 620 of outer frame 480 includes elongate members 660 and 670 connected to and extending in the same direction from opposite ends of elongate member 680. In the illustrated embodiment elongate members 660 and 670 are preferably parallel to each other, although this is not a requirement, and extend in a substantially vertical direction and elongate member 680 extends in a substantially horizontal direction. Elongate members 660, 670 can be telescoping such that a position of binding section 630 can be adjusted. Elongate members 690 and 700 extend from ends of elongate members 660 and 670, respectively, opposite elongate member 680 inwardly towards each other. In the illustrated embodiment elongate members 690 and 700 are preferably parallel to elongate member 680, although this is not a requirement. Truss members 710, 720, 730 and 740 are located at respective intersections of elongate members 660, 670, 680, and 690 and provide increased rigidity to yoke section 620. Yoke section 640 of inner frame 490 includes elongate members 750 and 760 connected with opposite ends of elongate member 770 by connecting members 780 and 790, respectively, and elongate members 750 and 760 substantially extend in the same direction from elongate member 770. In the illustrated embodiment elongate members 750 and 760 are preferably parallel to each other, although this is not a requirement, and extend in a substantially vertical direction and elongate member 770 extends in a substantially horizontal direction. Elongate members 750 and 760 can be telescoping such that a position of binding section 650 can be adjusted. Members 800 and 810 extend from ends of elongate members 750 and 760, respectively, opposite elongate member 770 inwardly towards each other. In the illustrated embodiment members 800 and 810 are preferably parallel to elongate member 770, although this is not a requirement. Truss members 820 and 830 are located near respective virtual intersections of elongate members 750, 760, and 770 and provide increased rigidity to yoke section 640.

Binding sections 630 and 650 can be disposed around the torso of the user with binding section 630 below binding section 650. More particularly, binding section 630 of outer frame 480 can be disposed in the vicinity or around a height of the pelvis or the lumbar spinal region of the user and binding section 650 of inner frame 490 can be disposed in the vicinity or around a height of the lumbar spinal region or the thoracic spinal region of the user, as will be described in more detail below. With continued reference to FIG. 13, binding section 630 includes elongate members 840 and 850 spaced apart from each other and connected together at opposite ends by elongate members 860 and 870. In the illustrated embodiment elongate members 840 and 850 can form two parallel sides, preferably at the same height, and elongate members 860 and 870 can form two other parallel sides of a rectangle, although in other embodiments other binding sections previously discussed can be employed. Yoke section 620 is rigidly connected to binding section 630 at the intersection of elongate members 690 and 860 and the intersection of elongate members 700 and 870. In other embodiments, elongate members 690 and 700 are not required such that elongate members 860 and 870 of binding section 630 are connected to elongate members 660 and 670, respectively of yoke section 620. Binding section 630 can be connected to yoke section 620 by fasteners or by a weld, for example. Binding section 650 includes elongate members 880 and 890 spaced apart and preferably parallel and elongate members 900 and 910 spaced apart and preferably parallel to each other and orthogonal to elongate members 880 and 890. Connecting members 920, 930, 940, and 950 connect respective ends of elongate members 880, 890, 900, and 910 together forming a boxed-in-like shape, and provide clearance between binding section 650 of inner frame 490 and yoke section 620 of outer frame 480, particularly as outer frame 480 and inner frame 490 rotate about pivot axis 110. In other embodiments binding section 650 can have a quadrilateral shape. Yoke section 640 is rigidly connected to binding section 650 at the intersection of member 800 and elongate member 900 and the intersection of member 810 and elongate member 910. In other embodiments, members 800 and 810 are not required such that elongate members 900 and 910 of binding section 650 are connected to elongate members 750 and 760, respectively of yoke section 640. The elongate members of outer and inner frame 480 and 490 can be tubes, and preferably square tubes.

Figure 10:
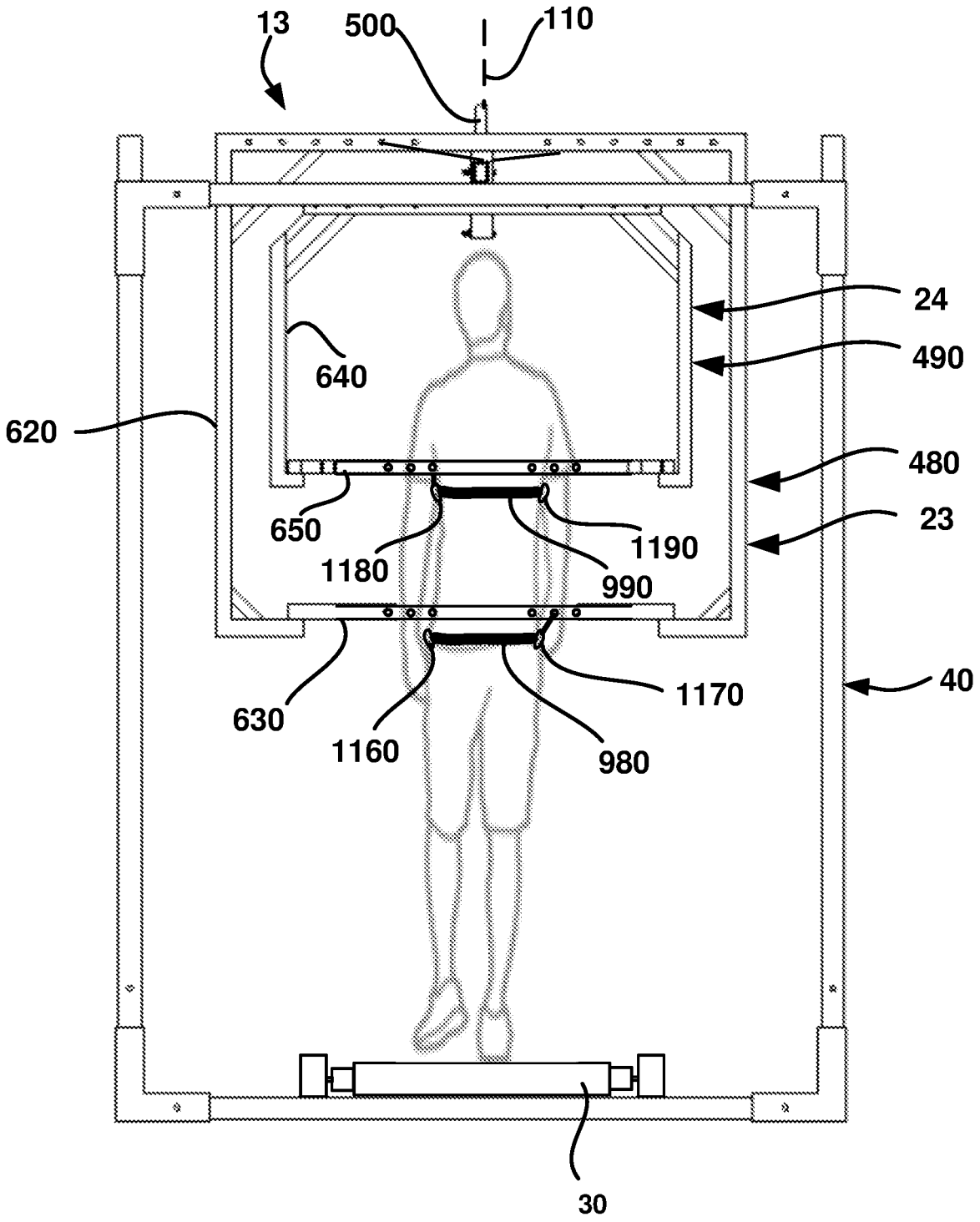
FIG. 10 is a side elevational view of the biased lever-arm of FIG. 9 configured with a treadmill and illustrated with a user.
Figure 11:
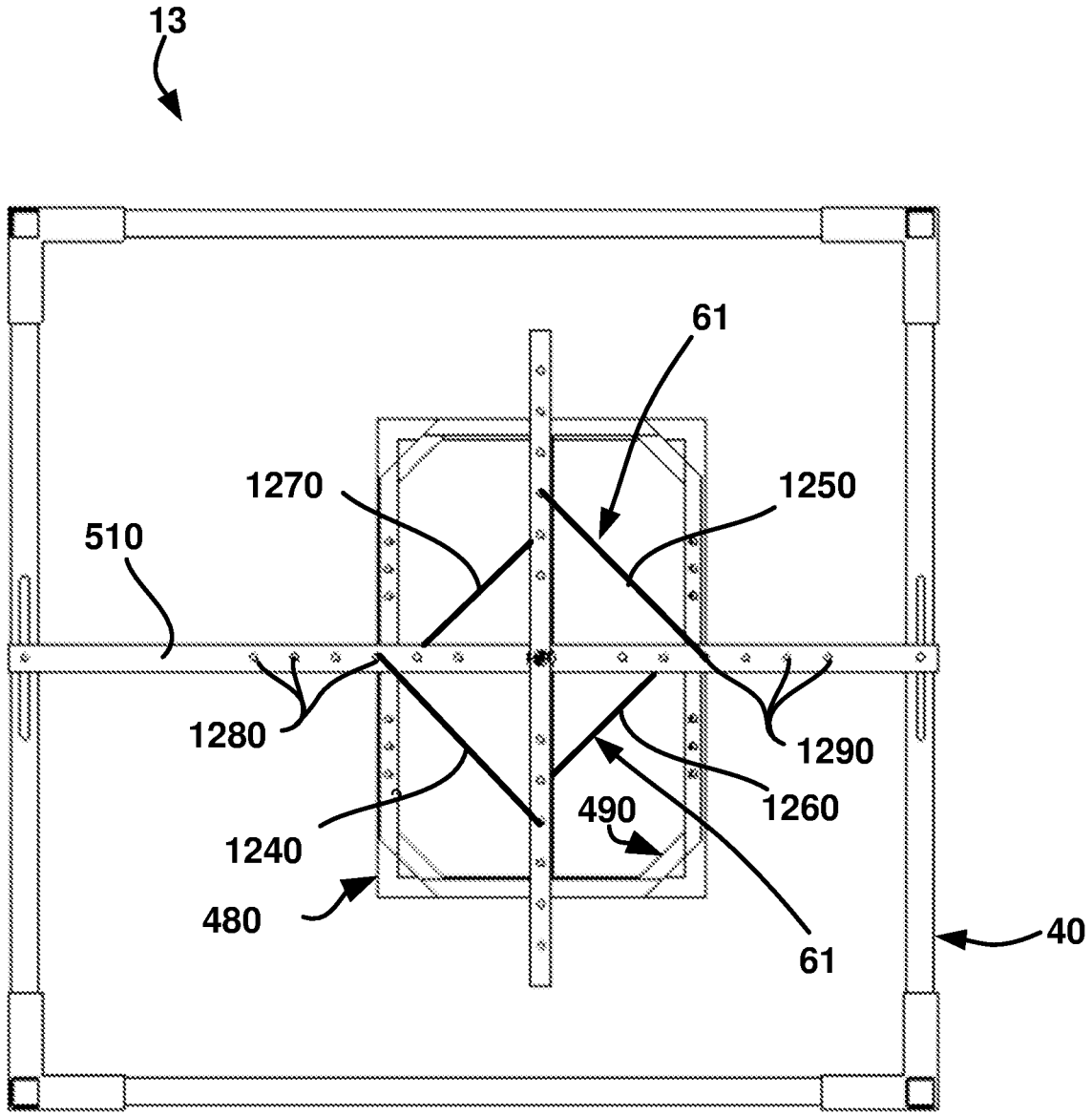
FIG. 11 is a top plan view of the biased lever-arm of FIG. 9 illustrating straps employed to bias the biased lever-arm.
Figure 12:
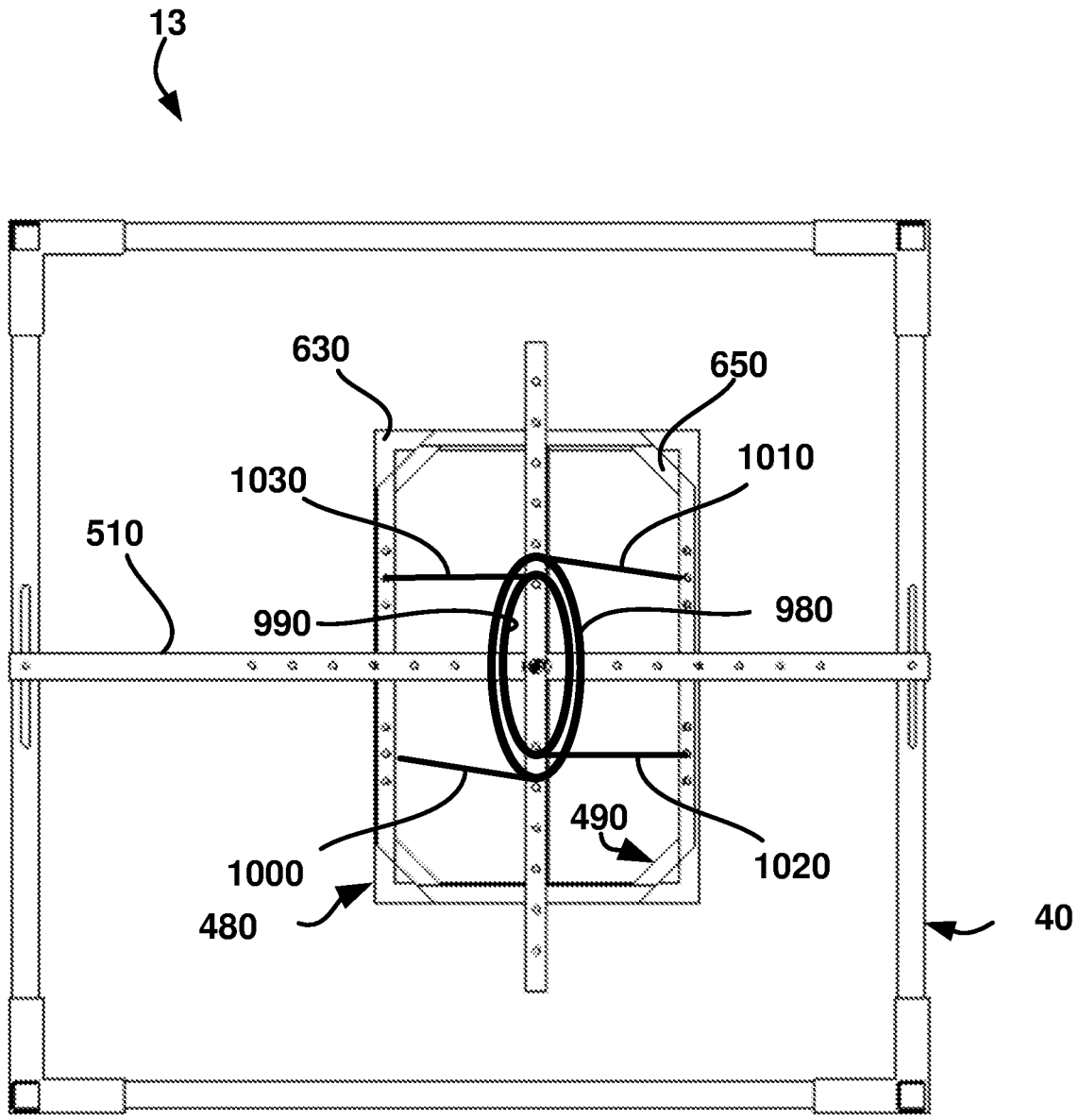
FIG. 12 is a top plan view of the biased lever-arm of FIG. 9 illustrating straps employed to connect a user to the biased lever-arm.

With reference now to FIGS. 10 and 13, a user stands within interior or user space 960 of binding section 630 and within interior or user space 970 of binding section 650. The user can wear lower harness 980 and upper harness 990 around the torso, with lower harness 980 disposed below upper harness 990. More particularly, the user can wear lower harness 980 around the pelvis or the lumbar spinal region, and upper harness 990 around the lumbar spinal region or the thoracic spinal region. Harnesses 980 and 990 can be separate harnesses like a belt, a strap, or a mountain climbing harness, or different sections of a full body harness, for example a first responder-type of harness. Harnesses 980 and 990 can be like harness 320 in FIG. 1 (including the couplers). Note that preferably only one of harnesses 980 and 990 is worn around the lumbar spinal region at a time. A particular configuration of biased lever-arm 13 is now discussed. With reference to FIG. 12, connecting straps 1000 and 1010 connect lower harness 980 to binding section 630 of outer frame 480, and connecting straps 1020 and 1030 connect upper harness 990 to binding section 650 of inner frame 490 in one configuration. The same rules can apply to connecting straps 1000 and 1010 when connecting to lower harness 980 and connecting straps 1020 and 1030 when connecting to upper harness 900 as applied to connecting straps 360 and 370 when connecting to harness 320 with respect to where on the respective harnesses the connecting straps are fixed and the relationship between the connecting straps 1000, 1010, 1020, and 1030 and the lines of force exerted by lever arm 23 and 24 on the connecting straps (that is, the first angle and the second angle referred to in relation to FIG. 7). It is noteworthy that either connecting strap 1000 or 1010 can be employed singularly to connect lower harness 980 to binding section 630 of outer frame 480, or more preferably they can be employed together; and either connecting strap 1020 or 1030 can be employed singularly to connect upper harness 990 to binding section 650 of inner frame 490, or more preferably they can be employed together. Connecting straps 1000, 1010, 1020, and 1030 can be flexible, elastic straps that allow for elongation, such as a bungee cord or a rubber band, and these straps can include hook connectors at opposite ends for easy connection to structures. For example, bungee cord 1040 shown in FIG. 17 with hooking members 1050 and 1060 can be employed as connecting straps 1000, 1010, 1020, and 1030. When connecting straps 1000, 1010, 1020, and 1030 are elastic the user can wobble to a greater degree around pivot axis 110 of cylindrical member 500 compared to when the straps are not elastic, which allows the user to have a more natural gait on treadmill 30 (seen in FIG. 10) when using the elastic straps. The user can experiment with bungee cords of different lengths and different amounts of elongation. Alternatively, connecting straps 1000, 1010, 1020, and 1030 can be plastic or rigid (like nylon straps) or slightly flexible (like tarp straps). Straps that are plastic and not flexible (elastic) can be beneficial when bores 550 and 610 (seen in FIG. 16) in frames 480 and 490, respectively, provide sufficient tolerance with respect to cylindrical member 500 such that frames 480 and 490 can themselves wobble when rotating about pivot axis 110. Referring back to FIG. 13, elongate members 840 and 850 of binding section 630 have bores 1080, 1090 and 1100, 1110, respectively, and elongate members 880 and 890 of binding section 650 have bores 1120, 1130 and 1140, 1150, respectively. Referring to FIGS. 10, 12 and 13, a particular configuration is discussed. Connecting strap 1000 can be fed through loop 1160 of lower harness 980 such that both hooking members at opposite ends of the strap fasten to one or more of bores 1080; connecting strap 1010 can be fed through loop 1170 of lower harness 980 such that the hooking members fasten to one or more of bores 1110; connecting strap 1020 can be fed through loop 1180 of upper harness 990 such that the hooking members fasten to one or more of bores 1140; and connecting strap 1030 can be fed through loop 1190 of upper harness 990 such that the hooking members fasten to one or more of bores 1130. Note that connecting straps 1000, 1010 and 1020, 1030 can connect to outer and inner frames 480 and 490, respectively, in other ways. Referring to FIG. 13, yoke section 620 of outer frame 480 can have a plurality of bores 1200 and a plurality of bores 1210 separated by cylindrical member 500; and yoke section 640 of inner frame 490 can have a plurality of bores 1220 and a plurality of bores 1230 separated by cylindrical member 500; and elongate support 510 can have a plurality of bores 1280 and a plurality of bores 1290 separated by cylindrical member 500. Referring to FIGS. 11 and 13, biasing straps 1240 and 1250 form one biasing device 61 and biasing straps 1250 and 1260 form another biasing device 61. Biasing straps 1240, 1250, 1260, and 1270 are elastic straps. Biasing straps 1240 and 1250 can connect and bias outer frame 480 to elongate support 510, and more particularly biasing strap 1240 can connect one of the plurality of bores 1200 in outer frame 480 to one of the plurality of bores 1280 in elongate support 510, and biasing strap 1250 can connect one of the plurality of bores 1210 of outer frame 480 to one of the plurality of bores 1290 in elongate support 510. Either biasing strap 1240 or 1250 can be employed singularly to connect and bias outer frame 480 to elongate support 510, or more preferably they can be employed together. Biasing straps 1260 and 1270 can connect and bias inner frame 490 to elongate support 510, and more particularly biasing strap 1260 can connect one of the plurality of bores 1220 of inner frame 490 to one of the plurality of bores 1290 in elongate support 510, and biasing strap 1270 can connect one of the plurality of bores 1230 of inner frame 490 to one of the plurality of bores 1280 in elongate support 510. Either biasing strap 1260 or 1270 can be employed singularly to connect inner frame 490 to elongate support 510, or more preferably they can be employed together. Biasing straps 1240, 1250, 1260, and 1270 can be rubber bands or bungee cords like bungee cord 1040 seen in FIG. 17 and operate to bias respective inner and outer frames 480 and 490 around cylindrical member 500 (where a longitudinal axis of cylindrical member 500 is aligned with pivot axis 110). In other embodiments at least one of biasing straps 1240 or 1250 can be employed to bias frame 480, and at least one of biasing straps 1260 and 1270 can be employed to bias frame 490. In the illustrated configuration of connecting straps 1000, 1010, 1020, and 1030 and biasing straps 1240, 1250, 1260, and 1270 just described, outer frame 480 is biased clockwise and inner frame 490 is biased counter-clockwise in the perspective of FIGS. 11 and 12, and accordingly outer frame 480 exerts a clockwise torque on the torso of the user (for example, on the pelvis or the lumbar spinal region) and inner frame 490 exerts a counter-clockwise torque on the torso of the user (for example, the lumbar spinal region or the thoracic spinal region) as the user walks or runs on treadmill 30 (seen in FIG. 10), either forwards or backwards. Attaching biasing strap 1240 between a different pair of bores from the plurality of bores 1200 and 1280 and attaching biasing strap 1250 between a different pair of bores from the plurality of bores 1210 and 1290 can increase or decrease the biasing force or torque at a given angular position of outer frame 480. Similarly, attaching biasing strap 1260 between a different pair of bores from the plurality of bores 1220 and 1290 and attaching biasing strap 1270 between a different pair of bores from the plurality of bores 1230 and 1280 can increase or decrease the biasing force or torque at a given angular position of inner frame 490. Alternatively, biasing straps 1240, 1250, 1260, and 1270 of varying length or varying elasticity can be employed to increase or decrease the biasing force at a given angular position. These forces on the user's pelvis and chest may tend to oppose the compensatory forces exerted on the user's pelvis and chest due to a leg length difference or other abnormalities. In an opposite arrangement of the connecting straps 1000, 1010, 1020, and 1030 and biasing straps 1240, 1250, 1260, and 1270, (not illustrated) outer frame 480 exerts a counter-clockwise force on the user's pelvis for example and inner frame 490 exerts a clockwise force on the user's chest for example, and these forces on the user's pelvis and chest tend to oppose the compensatory forces exerted on the user's pelvis and chest due to a leg length difference or other abnormalities. In further arrangements the outer and inner frames can be biased in the same direction around cylindrical member 500 and either biased clockwise or counter-clockwise. Although biased lever-arm 13 is illustrated with treadmill 30 (seen in FIG. 10), in other embodiments other types of exercise equipment other than treadmills can be employed, such as a stationary bicycle, or a step climber.

Figure 19:
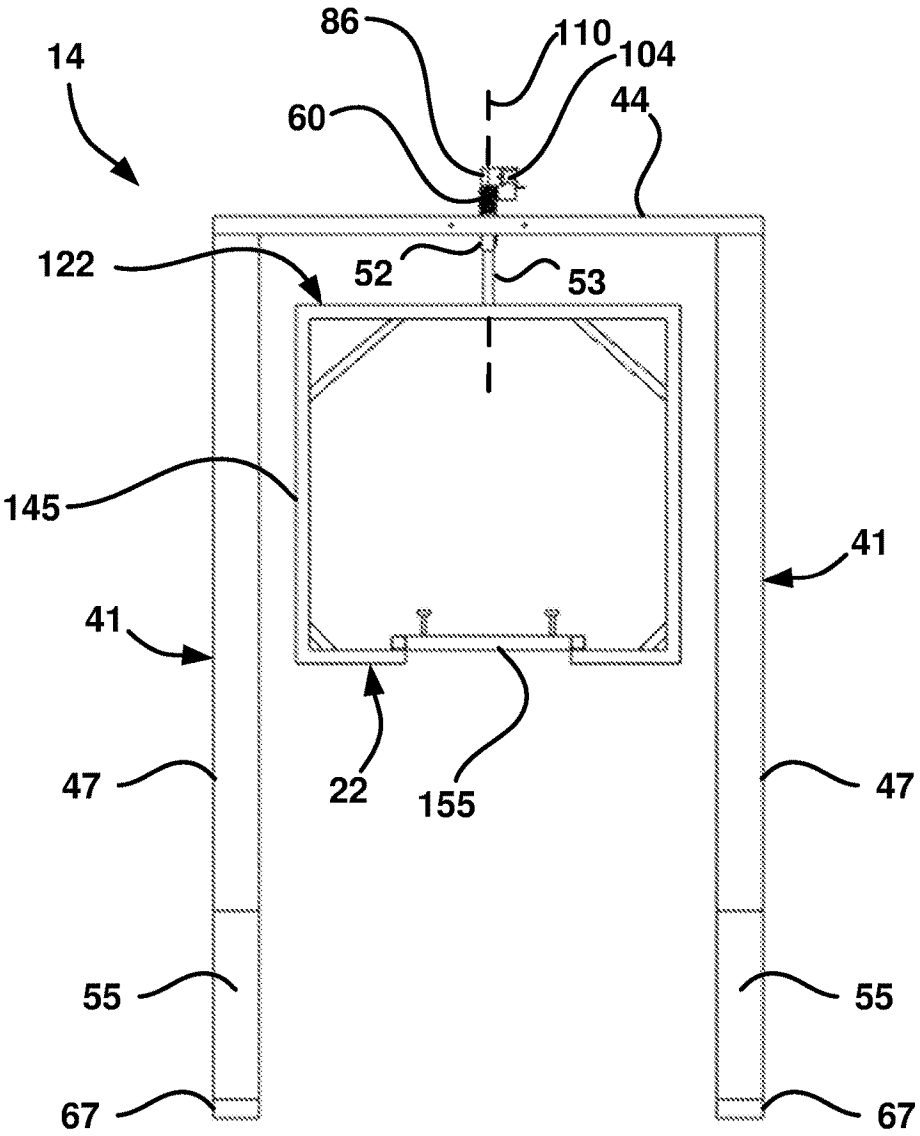
FIG. 19 is a side elevational view of the biased lever-arm of FIG. 18.
Figure 18:
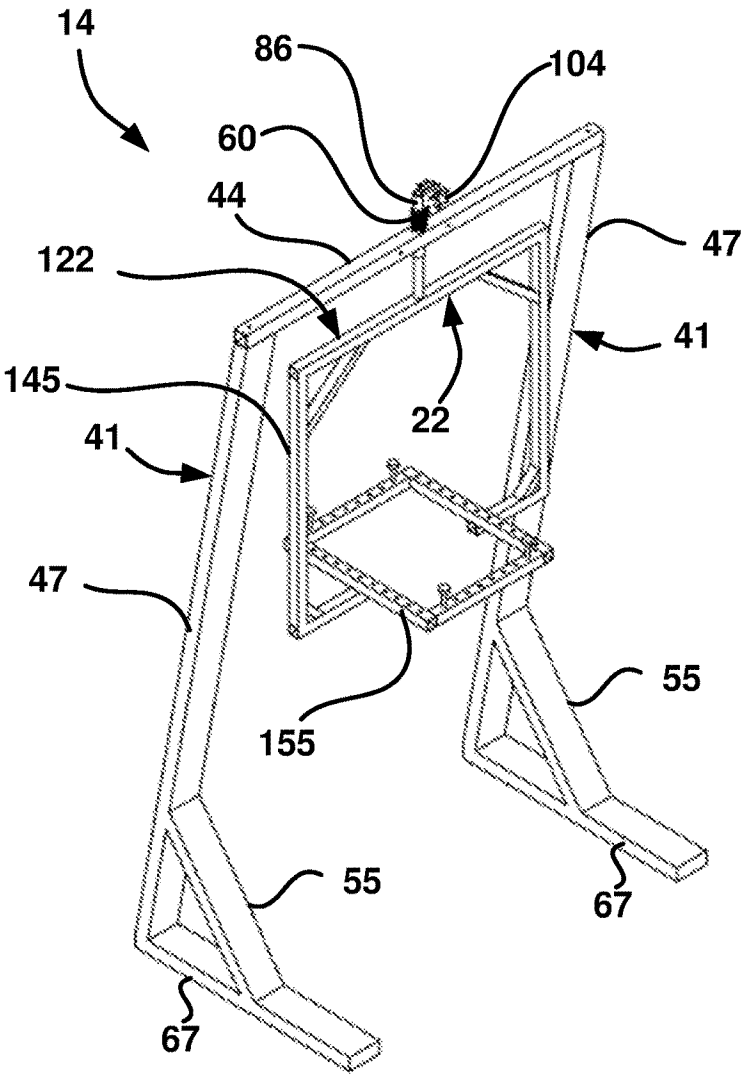
FIG. 18 is a perspective view of a biased lever-arm according to another embodiment.

Referring now to FIGS. 18 and 19 there is shown biased lever-arm 14 according to another embodiment that is similar to biased lever-arm 12 and at least the differences are discussed. Biased lever-arm 14 includes lever arm 22, biasing device 60, spring retainer 86, elongate support 44 and supports 41. Elongate support 44 is like support member 43 in FIGS. 3 and 4 except elongate support 44 is elongated to extend between a pair of supports 41. Elongate support 44 remains fixed in position, whereas support member 43 in FIGS. 3 and 4 can be slidably adjusted within elongate member 100 seen in FIG. 2. Lever arm 22 (described in detail in the embodiment of FIG. 8) is employed in the biased lever-arm 14, although in other embodiments lever arm 20 or 21 discussed with respect to FIGS. 2 and 7, respectively, could be alternatively employed. Supports 41 support elongate support 44 and lever arm 22. Each support 41 includes elongate member 47 extending upwardly, elongate member 67 extending horizontally and connected to elongate member 47, and truss member 55 extending between elongate members 47 and 67. Elongate members 47 and 67 form a substantially L-shaped structure where an angle between members 47 and 67 (in which truss member 55 spans) can be less than 90 degrees. Elongate support 44 extends between ends of elongate members 47 opposite elongate member 67. As with all embodiments herein, biased lever-arm 14 can be employed with a harness, like harnesses 320, 980 and 990, and exercise equipment such as a treadmill 30 (seen in FIG. 1) or other types of exercise equipment as previously discussed.

Figure 20:
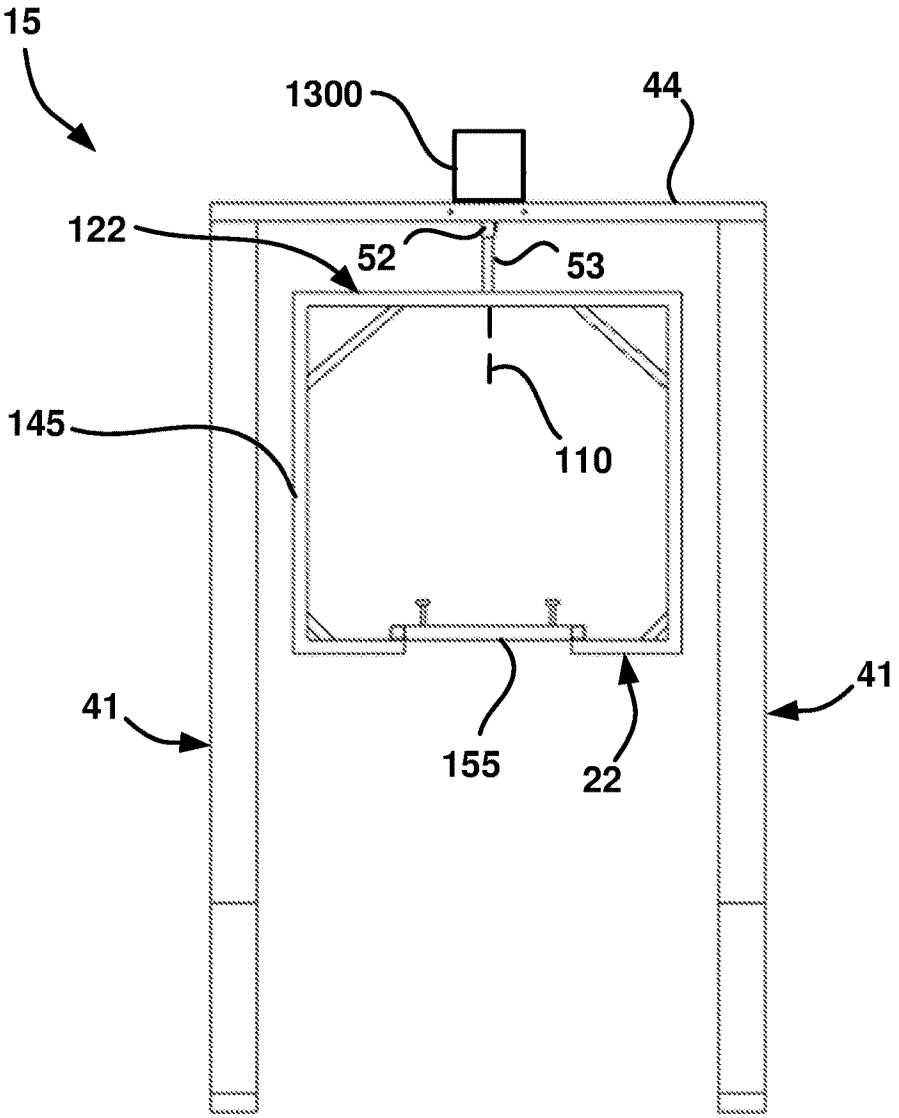
FIG. 20 is a side elevational view of a biased lever-arm according to another embodiment.

Referring now to FIG. 20 there is shown biased lever-arm 15 according to another embodiment that is similar to biased lever-arm 14 and at least the differences are discussed. Biasing device 1300 is configured above lever arm 22 and can be an electromagnetic biasing device that can produce rotary motion, for example a solenoid such as a rotary solenoid, or an electric motor that can provide a bias torque on cylindrical member 53 of lever arm 22 in either the clockwise direction or counter-clockwise direction depending upon the direction of the current through windings (not shown) of the electromagnetic device. Biasing device 1300 is supported by elongate support 44 and is electrically connected with an electrical power source (not shown), such as a wall outlet or a battery. Preferably, biasing device 1300 is in communication with a control device (not shown) that can be part of an exercise equipment such as treadmill 30 or a smart phone that includes a control app, where the control device manages the operation of biasing device 1300 such as turning the bias torque on and off and controlling an intensity of the bias torque. In other embodiments, frames 120 or 121 can be employed instead of frame 122.

Figure 21:
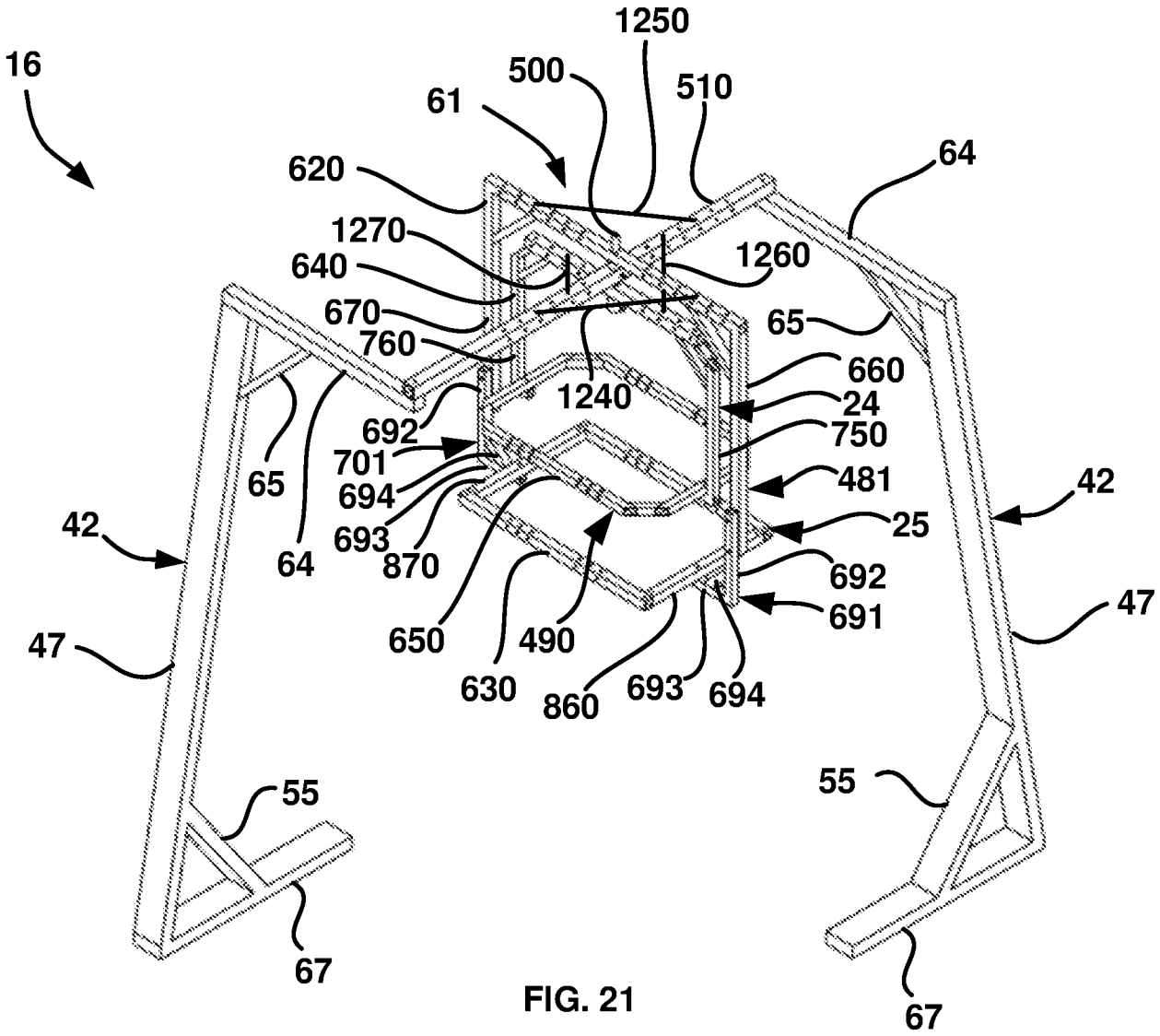
FIG. 21 is a side elevational view of a biased lever-arm according to another embodiment.
Figure 22:
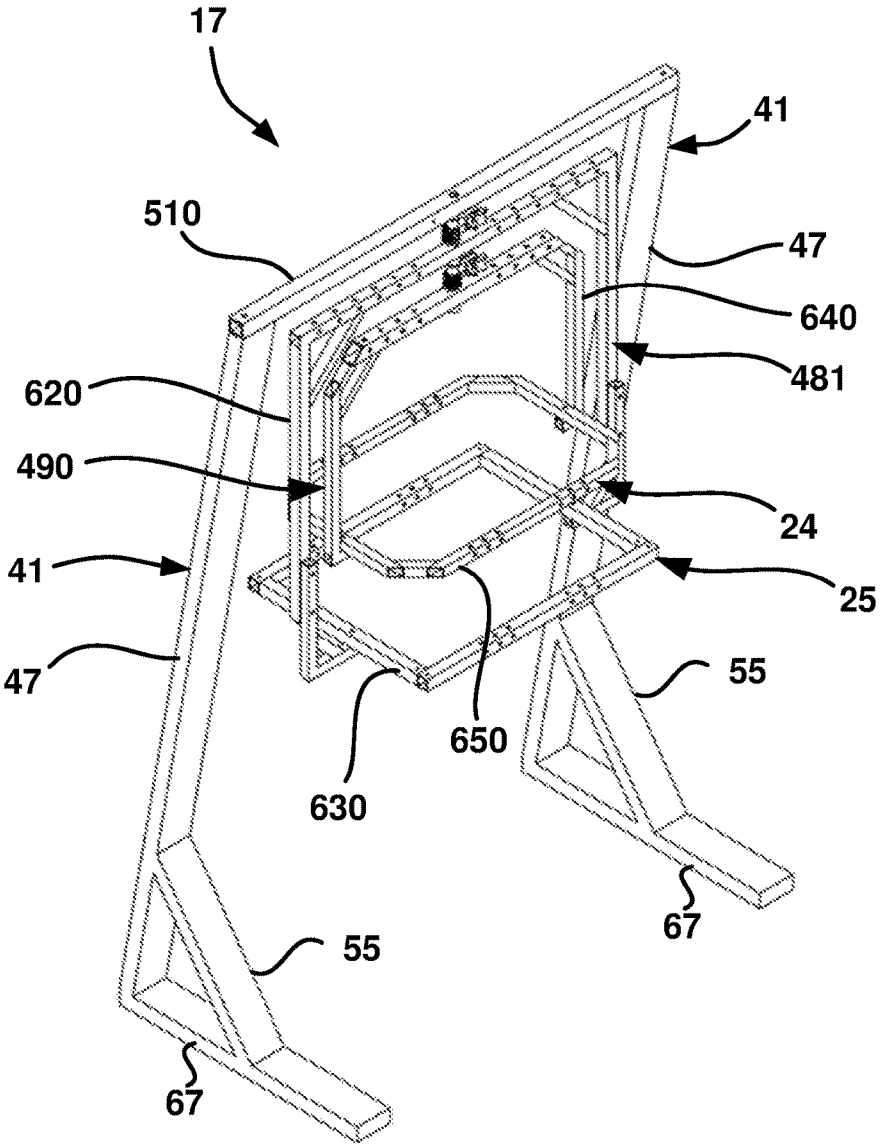
FIG. 22 is a perspective view of a biased lever-arm according to another embodiment.
Figure 23:
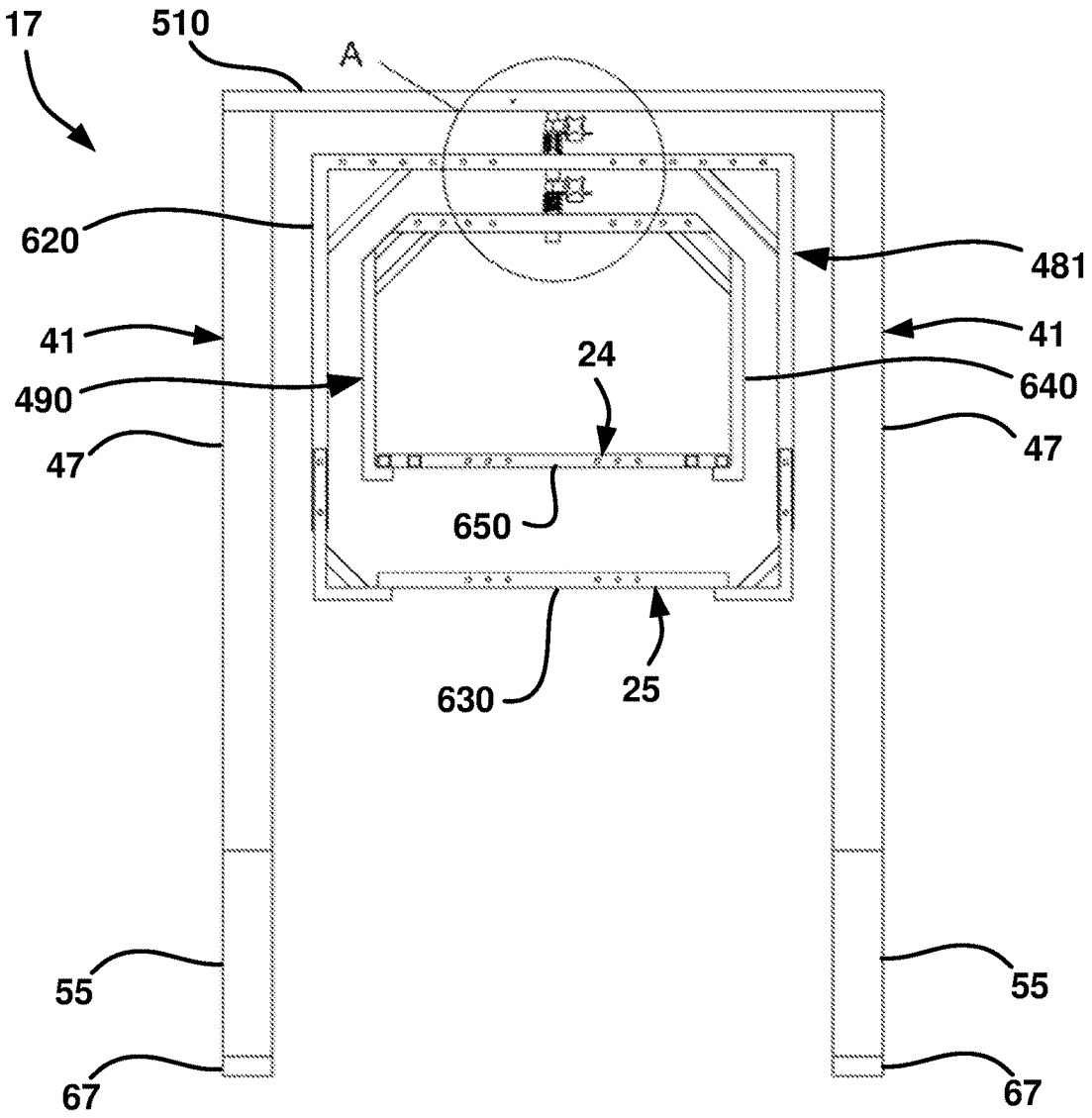
FIG. 23 is a side elevational view of the biased lever-arm of FIG. 22.

Referring to FIG. 21 there is shown biased lever-arm 16 according to another embodiment that is similar to biased lever-arm 13 (seen in FIGS. 9-16) and at least the differences are discussed. Biased lever-arm 16 includes all the elements of biased lever-arm 13 except support 40 and lever arm 23, and instead includes supports 42 that are each similar to support 41 in biased lever-arm 14 (seen in FIGS. 18-19) and lever arm 25 that will be described in more detail below. Each support 42 further includes elongate member 64 substantially extending horizontally and perpendicular to elongate member 47, preferably, and truss member 65 between elongate member 64 and elongate member 47. Elongate support 510 is supported at each end by one of the supports 42, which are each secured therewith. Lever arm 25 includes outer frame 481. Outer frame 481 is similar to outer frame 480 seen in FIG. 14, except that brackets 691 and 701 replaces elongate members 690 and 700, respectively. Each bracket 691 and 701 can include elongate members 692 and 693 that are connected in an L-shaped configuration preferably supported by truss member 694. With reference to bracket 691, elongate member 692 can be connected with elongate member 660 (e.g. with fasteners) and substantially extends vertically, preferably, and elongate member 693 can be connected with elongate member 860 of binding section 630 (e.g. with fasteners) and substantially extends horizontally, preferably. With reference to bracket 701, elongate member 692 can be connected with elongate member 670 (e.g. with fasteners) and substantially extends vertically, preferably, and elongate member 693 can be connected with elongate member 870 of binding section 630 (e.g. with fasteners) and substantially extends horizontally, preferably. Brackets 691 and 701 can be connected to elongate members 660 and 670, respectively, at one or more locations there along, such that the height of binding section 630 can be adjusted. Note that inner frame 490 can employ brackets similar to brackets 691 and 701 in other embodiments such that the height of binding section 650 can also be adjusted similarly to the height of binding section 630. Alternatively, elongate members 750 and 760 can be telescoping such that the height of binding section 650 can be adjusted in a telescopic manner. Similarly, outer frame 480 can be employed in other embodiments instead of outer frame 481, and in such embodiments elongate members 660 and 670 can also be telescoping such that the height of binding section 630 can be adjusted in the telescopic manner. It is understood that the elements identified by those reference numerals seen in FIGS. 9-17 that are not seen in FIG. 21 (except reference numeral 40) are also included in biased lever-arm 16. Biased lever-arm 16 can be employed with exercise equipment disclosed herein for previous biased lever-arms, like treadmill 30, where a user is connected to biased lever-arm 16 with a harness such as harnesses 320, 980, and 990, and connecting straps 1000, 1010, 1020, and 1030 while operating the exercise equipment, like biased lever-arm 13.

Figure 25:
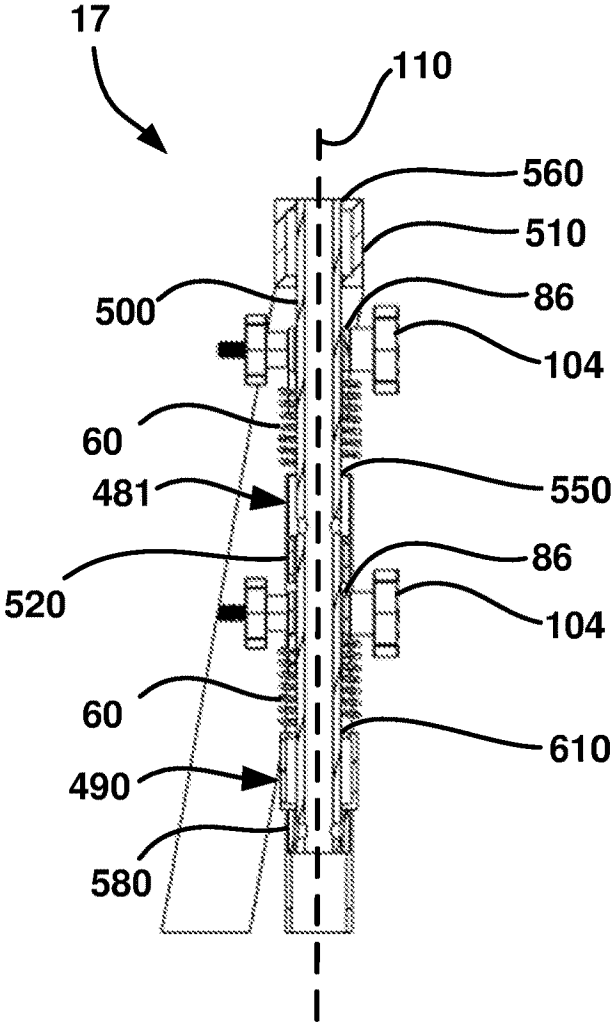
FIG. 25 is a cross-sectional view of a portion of the biased lever-arm of FIG. 24 taken along line A-A.
Figure 24:
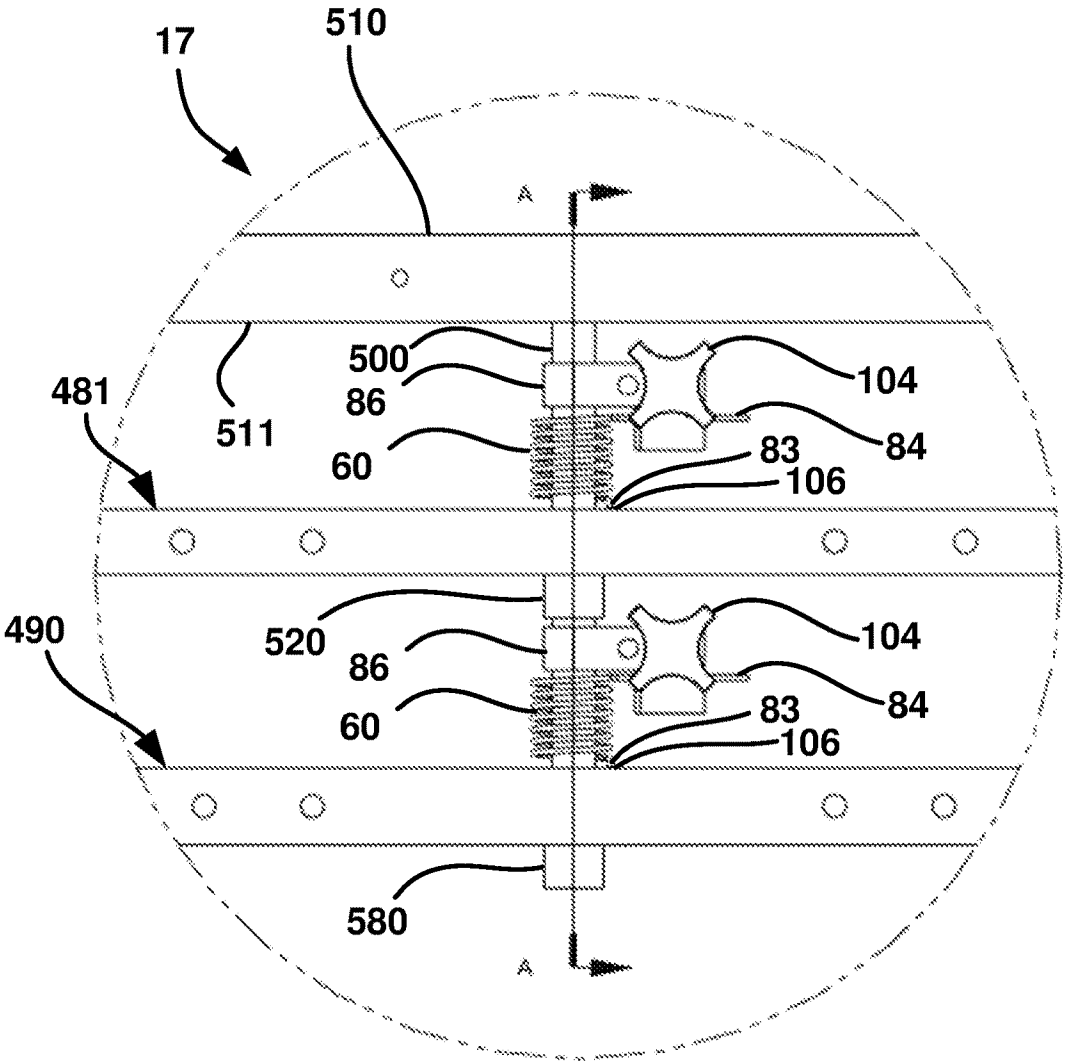
FIG. 24 is a detailed view of a portion of the biased lever-arm of FIG. 23 within circle A.
Figure 26:
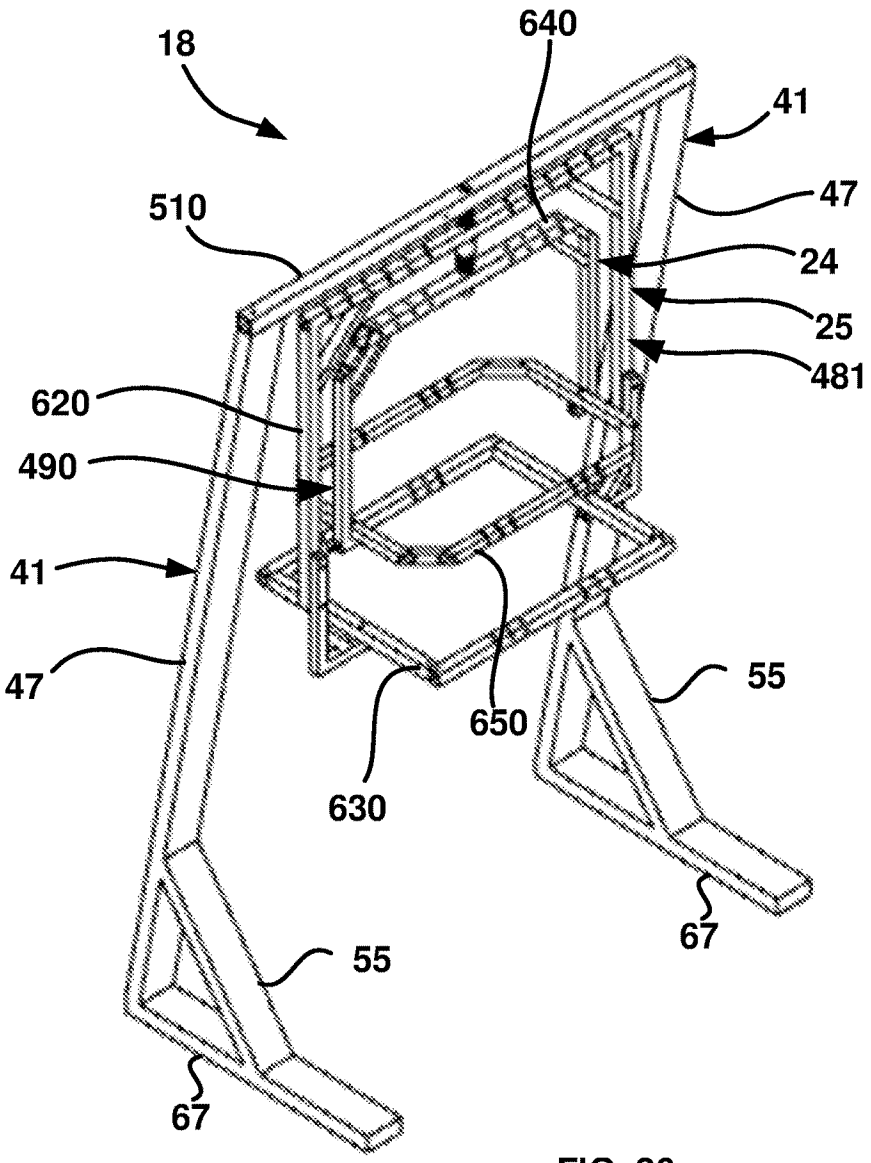
FIG. 26 is a perspective view of a biased lever-arm according to another embodiment.
Figure 27:
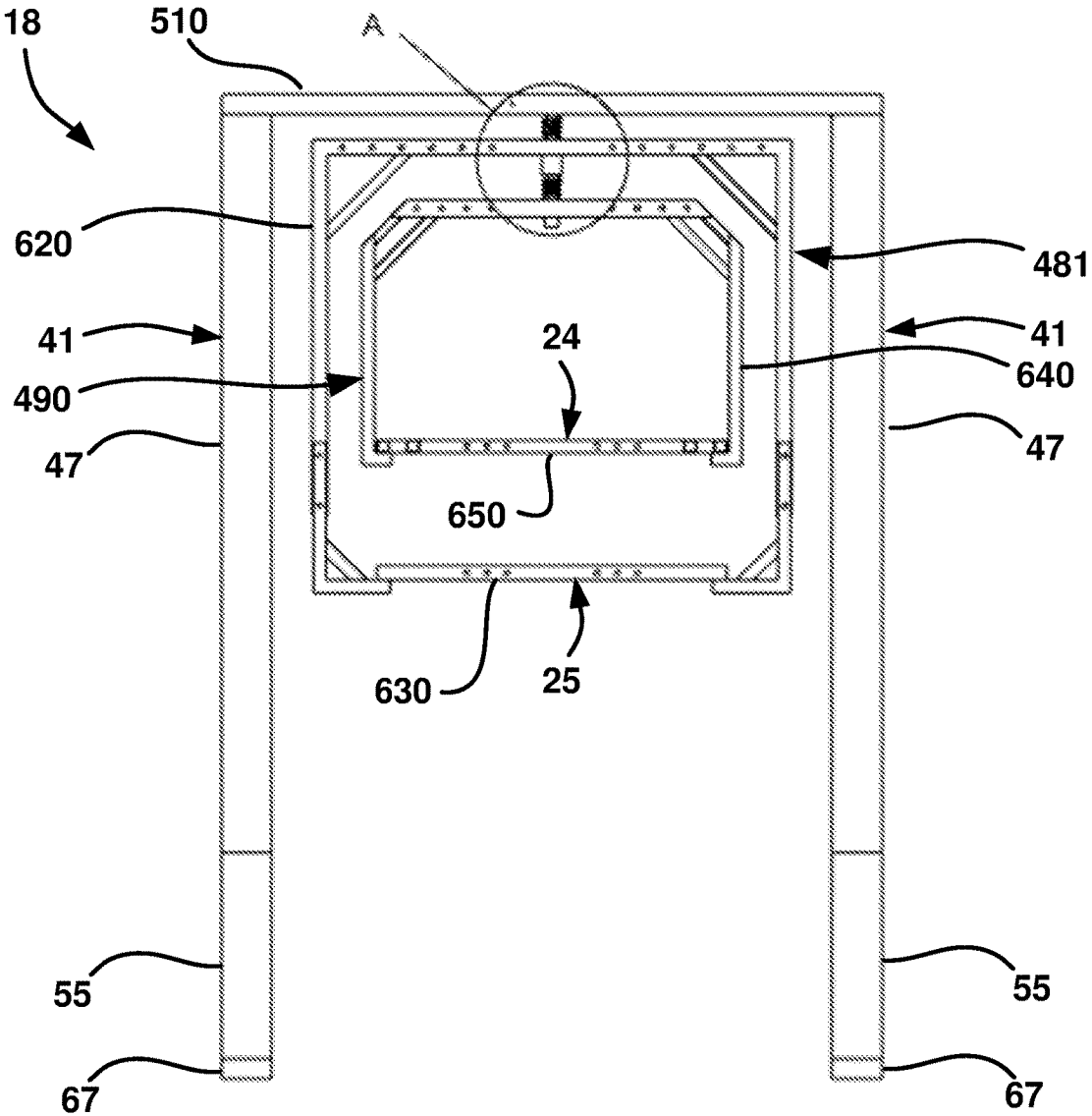
FIG. 27 is a side elevational view of the biased lever-arm of FIG. 26.

Referring to FIGS. 22-25 there is shown biased lever-arm 17 according to another embodiment that includes some features of biased lever-arm 10 (seen in FIG. 1) and biased lever-arm 14 (seen in FIG. 18) and at least the differences are discussed. Biased lever-arm 17 includes lever arm 24 and lever arm 25. Lever arm 25 includes outer frame 481 (or outer frame 480 in other embodiments) and lever arm 24 includes inner frame 490, both of which are disposed below elongate support 510. With reference to FIG. 25, cylindrical member 500 extends through bore 560 in elongate support 510 downwards, and can be secured to support 510 by a weld, a fastener, or a locking pin, for example, and extends through bore 550 in outer frame 481 and bore 610 in inner frame 490. Note that in other embodiments cylindrical member 500 can be welded to outer surface 511 (seen in FIG. 24) of elongate support 510 whereby bore 560 may not be required. Annular flange 520 supports outer frame 481 below elongate support 510 (unlike in biased lever-arm 14 seen in FIG. 16 where outer frame 480 is supported above support 510) and annular flange 580 supports inner frame 490 below elongate support 510 as well. Both outer frame 481 and inner frame 490 are rotatable about pivot axis 110 around cylindrical member 500. With reference to FIG. 24, respective axial legs 83 of springs 60 extend through bores 106 in outer frame 481 and inner frame 490, respectively, and in this regard outer frame 481 and inner frame 490 act as spring retainers as well. Each spring retainer 86 retains respective radial leg 84 with respect to cylindrical member 500, and the angular position of respective radial leg 84 can be set anywhere about pivot axis 110. In the illustrated embodiment each spring 60 is a LHW torsion spring. However, in other embodiments each spring 60 can be either a LHW or a RHW torsion spring, and springs 60 do not need to be both a LHW or both a RHW torsion spring simultaneously. Fasteners 104 are employed to secure respective spring retainers 86 to cylindrical member 500. Returning to FIGS. 22 and 23, in the illustrated embodiment support 41 supports elongate support 510. However, in other embodiments a pair of supports 42 (seen in FIG. 21) can support elongate support 510, or even other types of supports can be employed. Note that elongate support 510 can include bores 1280 and 1290 (seen in FIG. 11) in biased lever-arm 16 (seen in FIGS. 22-25); however, these bores would serve a different purpose, such as reducing weight, rather than as attachment points for straps since biasing straps 1240, 1250, 1260, and 1270 (seen in FIG. 11) are not employed in biased lever-arm 17.

Figure 29:
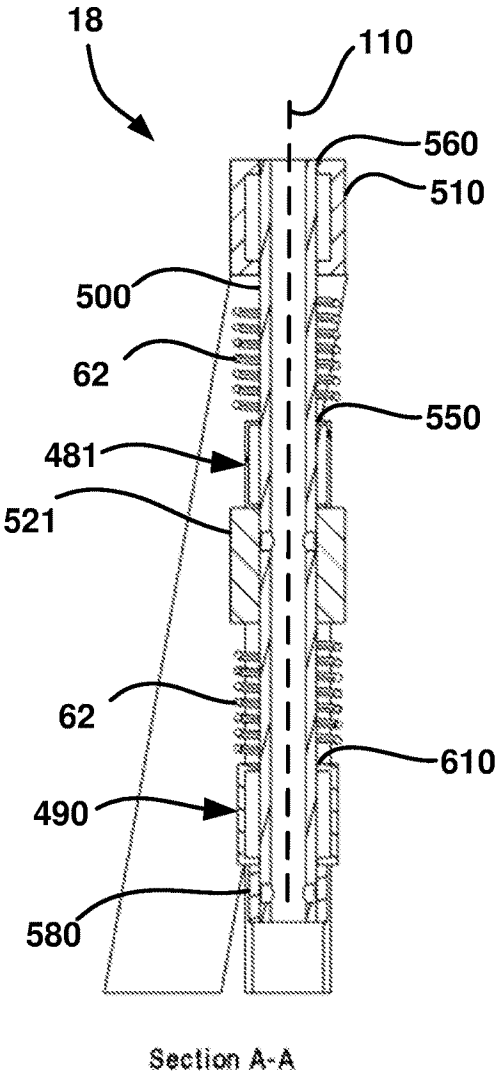
FIG. 29 is a cross-sectional view of a portion of the biased lever-arm of FIG. 28 taken along line A-A.
Figure 28:
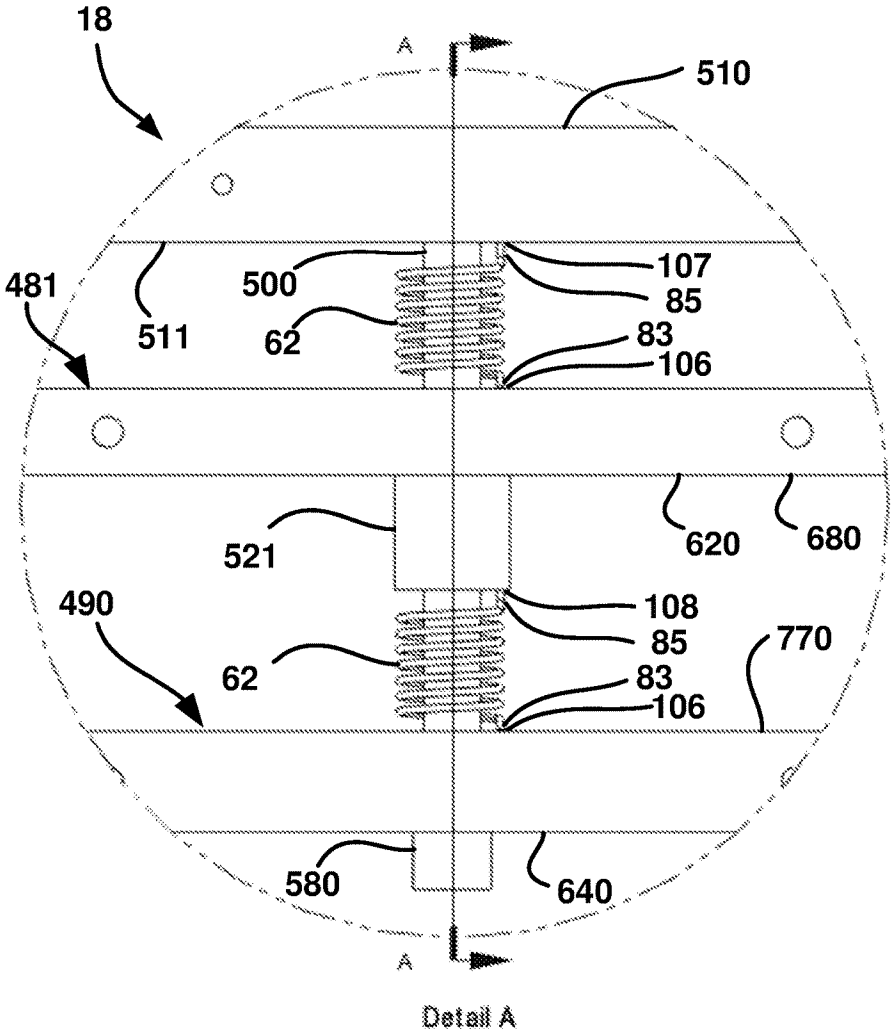
FIG. 28 is a detailed view of a portion of the biased lever-arm of FIG. 27 within circle A.
Figure 30:
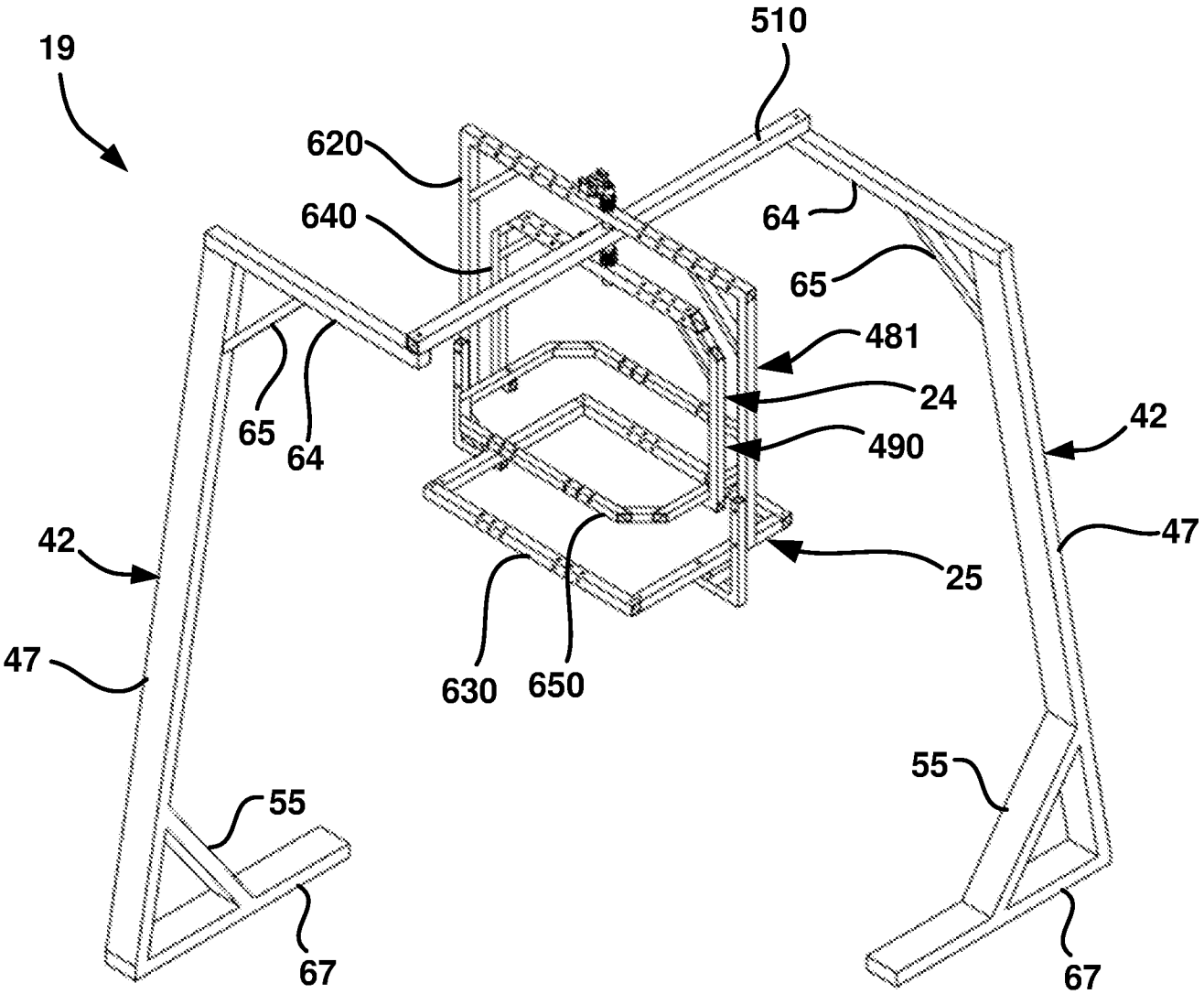
FIG. 30 is a perspective view of a biased lever-arm according to another embodiment.

Referring now to FIGS. 26-29 there is shown biased lever-arm 18 according to another embodiment that is similar to biased lever-arm 17 (seen in FIG. 22) and at least differences are discussed. In the illustrated embodiment, biased lever-arm 18 includes lever arm 24 and lever arm 25. With reference to FIGS. 28 and 29, elongate support 510 and annular flange 521 act as retaining members for respective biasing devices 62 instead of employing dedicated spring retainers 86 (seen in FIG. 24). Biasing device 62 can be a spring including axial legs 83 and 85 that can substantially extend in the same direction as a longitudinal axis of the spring. One spring 62 is retained by elongate member 680 of outer frame 481 (the base of yoke section 620) (or outer frame 480 in other embodiments) and elongate support 510, and the other spring 62 is retained by elongate member 770 of inner frame 490 (the base of yoke section 640) and annular flange 521. More particularly, referring first to spring 62 retained by outer frame 481 and elongate support 510, axial leg 83 extends into and is retained within bore 106 of outer frame 481 and axial leg 85 extends into and is retained within bore 107 of elongate support 510. Referring next to spring 62 retained by inner frame 490 and annular flange 521, axial leg 83 extends into bore 106 of inner frame 490 and axial leg 85 extends into bore 108 of annular flange 521. Annular flange 521 extends around cylindrical member 500 and can be secured thereto, for example by a fastener, a locking pin, or a weld, and also functions to support outer frame 481. Preferably, biased lever-arm 18 can be disassembled such that springs 62 can be exchanged with other springs with different spring constants or angular relationships of legs 83 and 85. In this regard, cylindrical member 500 can be connected with elongate support 510 and annular flanges 521, 580 by fasteners, locking pins or welds in a manner that allows biased lever-arm 18 to be disassembled and springs 62 replaced. Changing the spring constant while maintaining the angular relationship of axial legs 83 and 85 preserves the unbiased angular position of outer frames 481 or 490 (that is, the neutral position), while changing the amount of bias torque at relative angular positions displaced from the unbiased angular position. Changing the angular relationship of axial legs 83 and 85 while maintaining the spring constant adjusts the unbiased angular position of outer frames 481 or 490, while preserving the amount of bias torque at relative angular positions displaced from the unbiased angular position, but changes the amount of bias torque at absolute positions around pivot axis 110. Note that the angular relationship of axial legs 83 and 85 and the spring constant can be change simultaneously. Note that springs 62 do not need to be identically wound, for example one spring 62 can be RHW or LHW and, separately and independently, the other spring 62 can be RHW or LHW, as is the case with all embodiments herein employing two springs.

Figure 31:
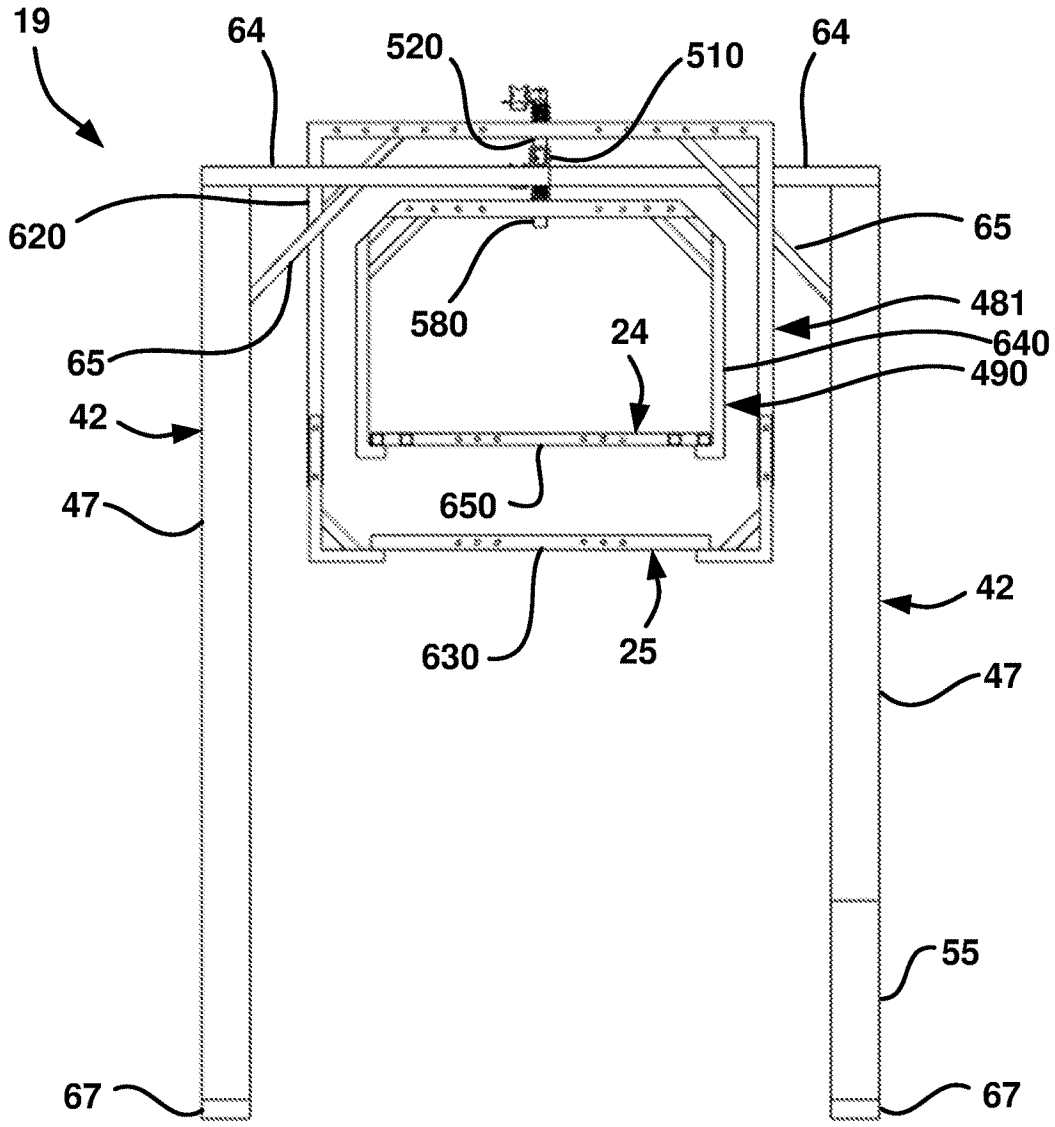
FIG. 31 is a front elevational view of the biased lever-arm of FIG. 30.
Figure 32:
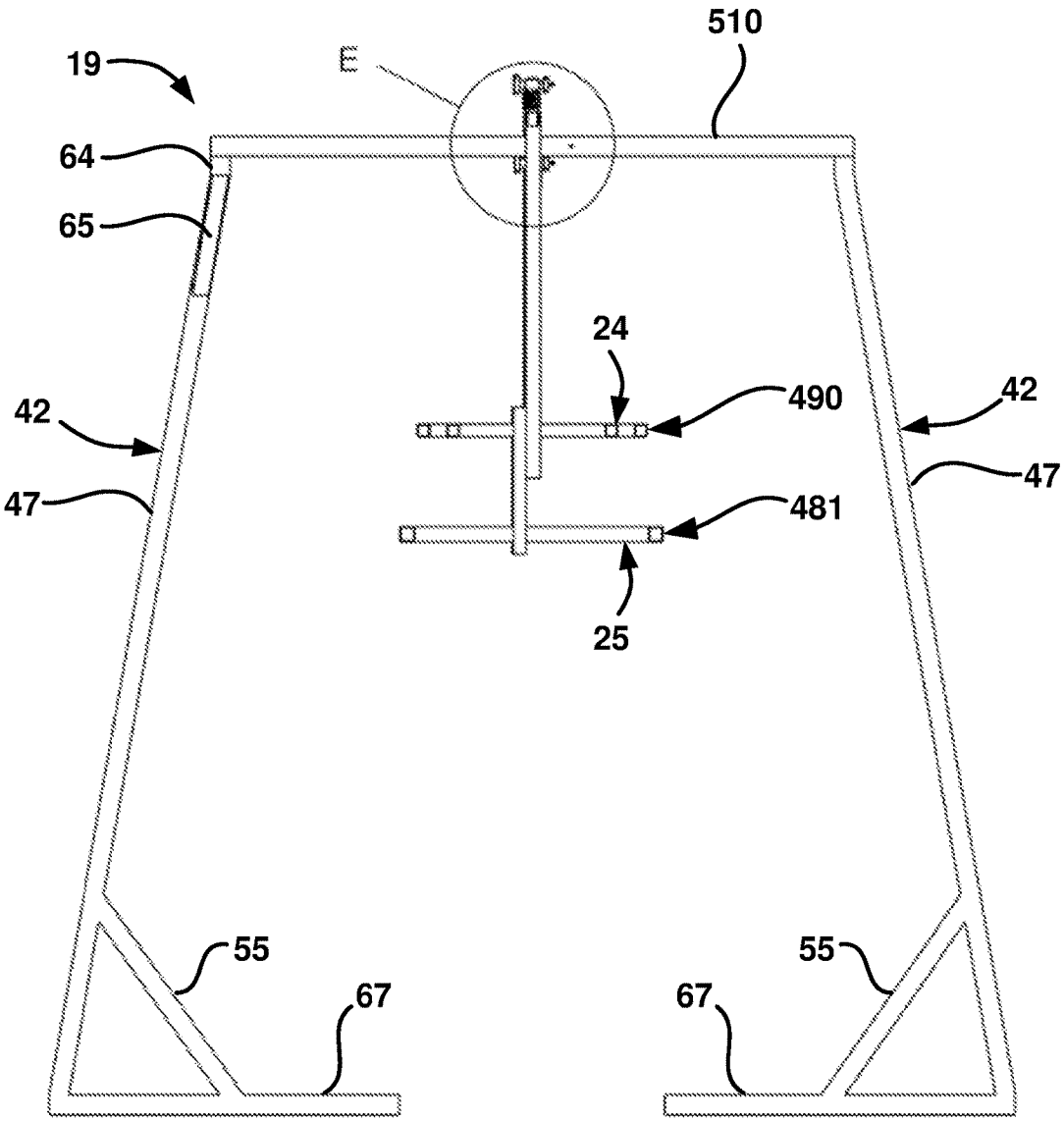
FIG. 32 is a side elevational view of the biased lever-arm of FIG. 31.
Figure 33:
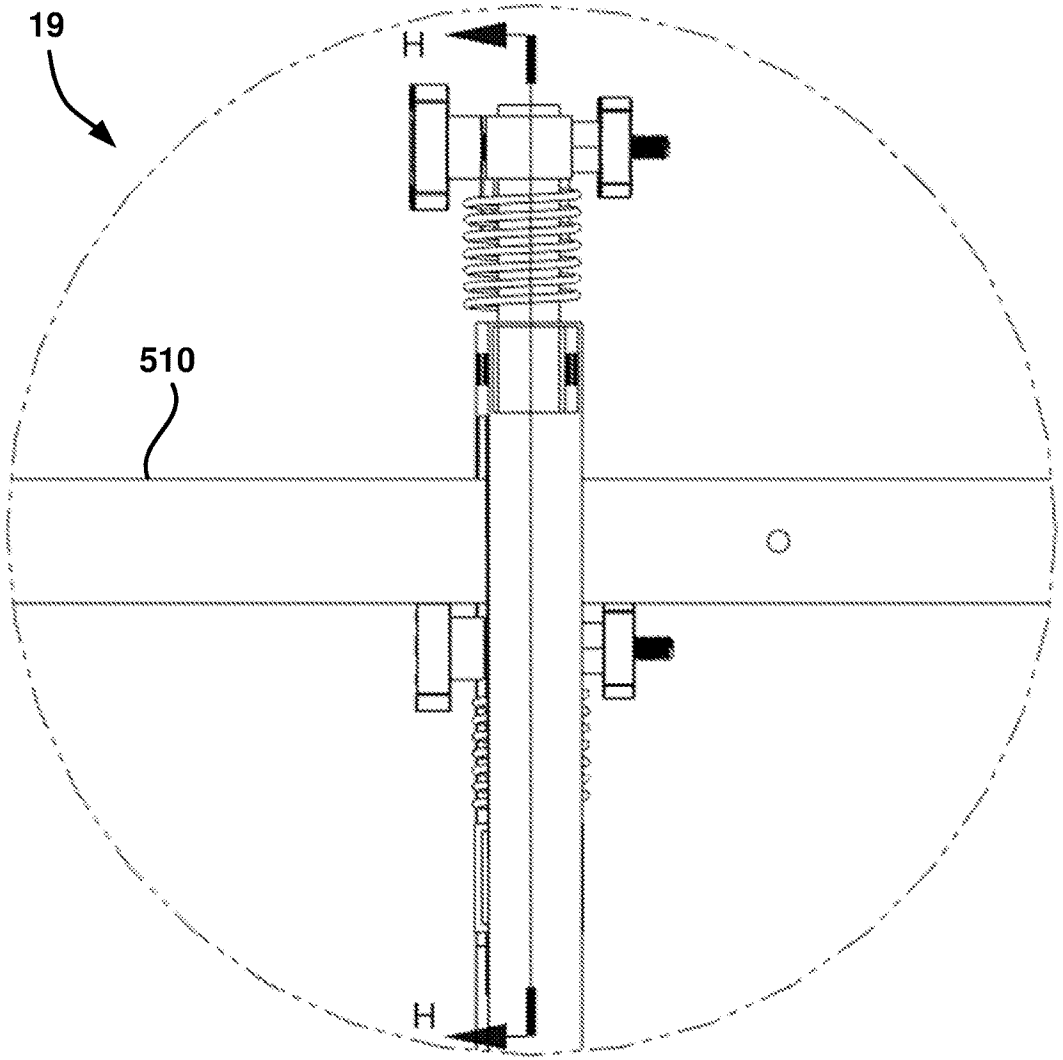
FIG. 33 is a detailed view of a portion of the biased lever-arm of FIG. 32 within circle E.
Figure 34:
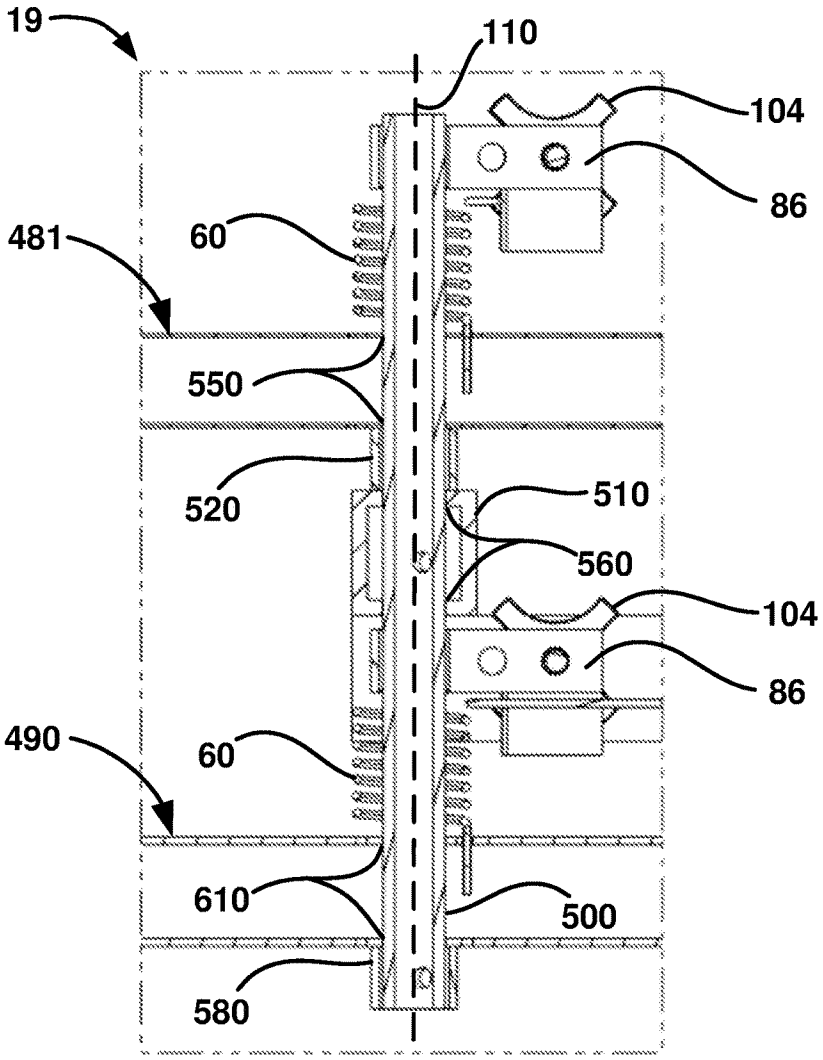
FIG. 34 is a cross-sectional view of a portion of the biased lever-arm of FIG. 33 taken along line H-H.
Figure 35:
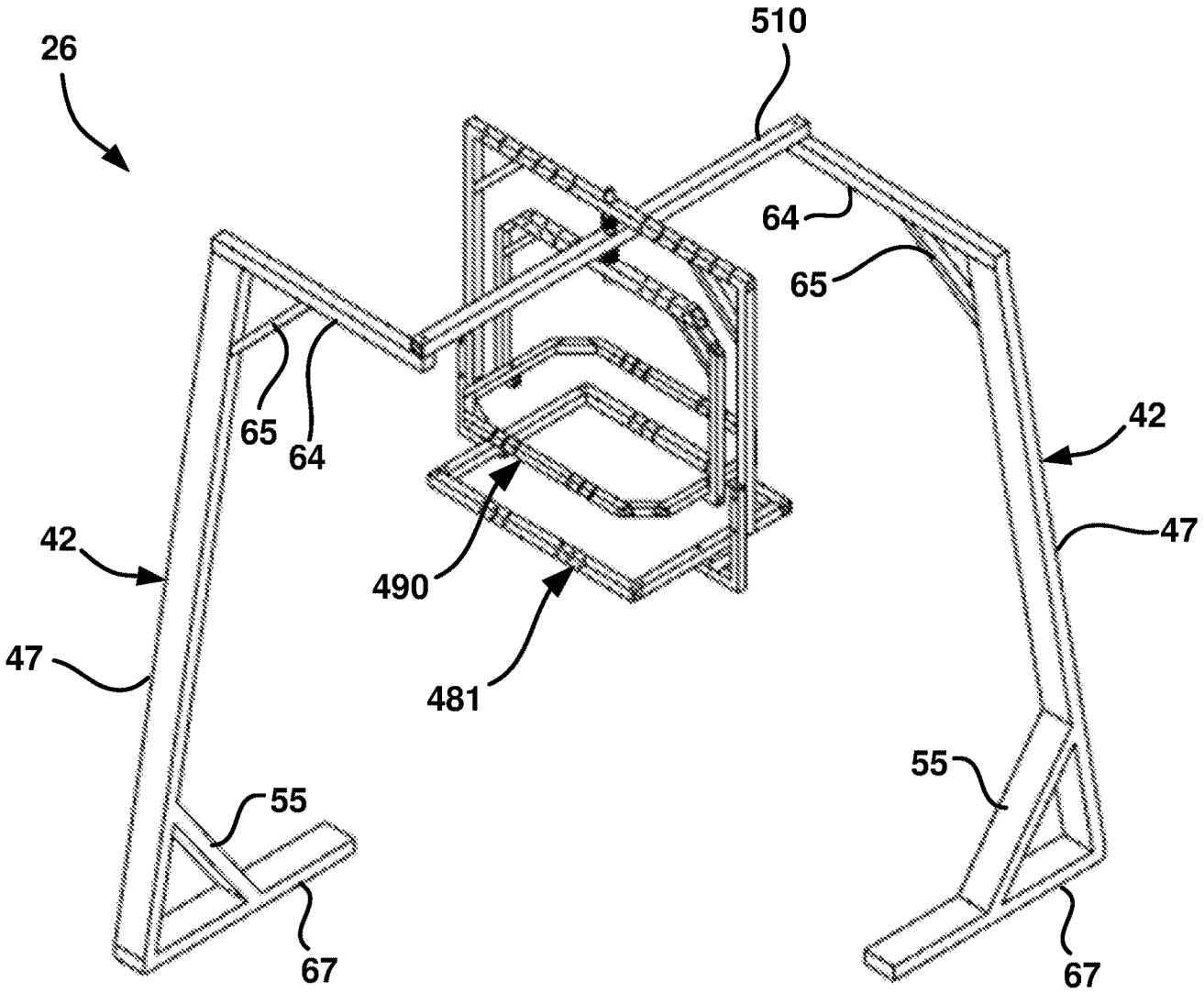
FIG. 35 is a perspective view of a biased lever-arm according to another embodiment.
Figure 37:
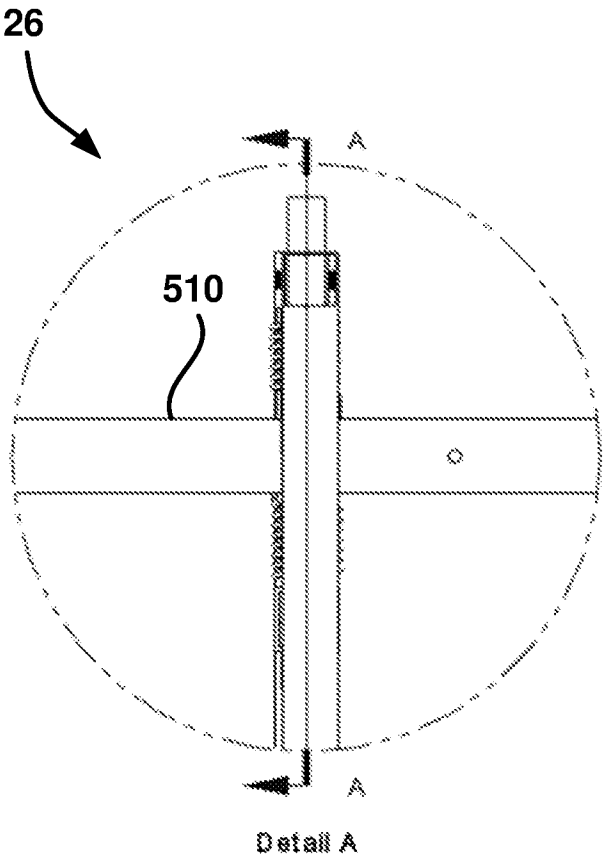
FIG. 37 is a detailed view of a portion of the biased lever-arm of FIG. 36 within circle A.
Figure 36:
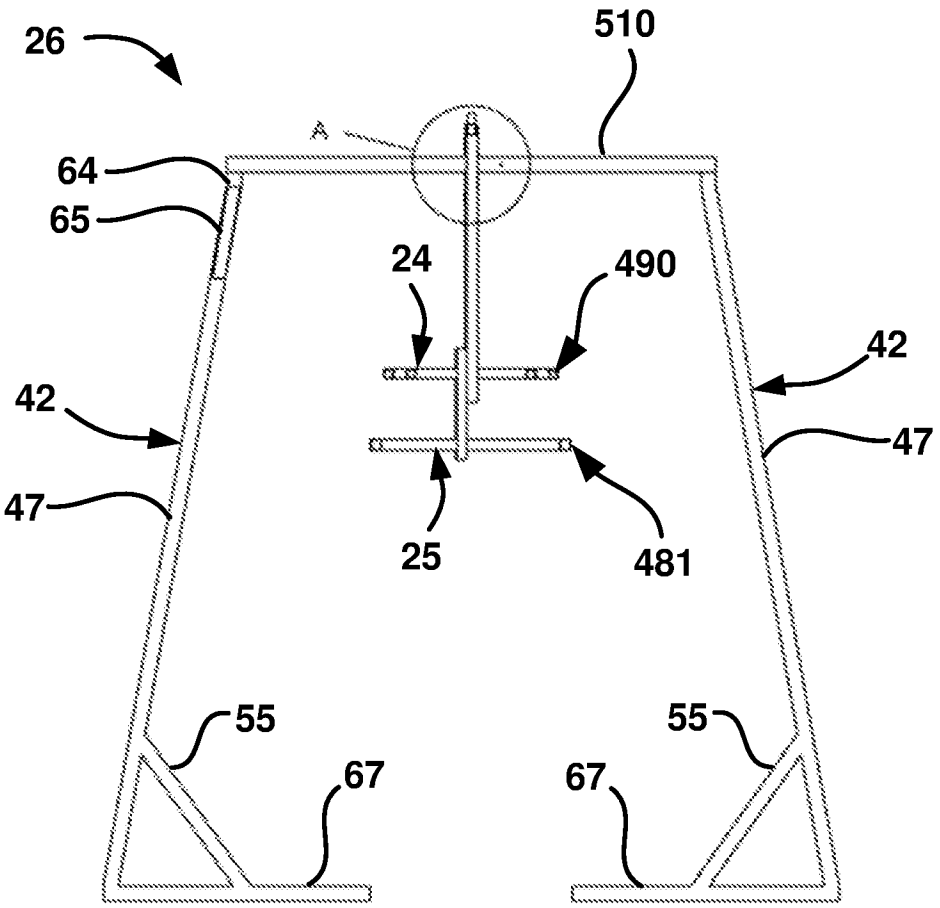
FIG. 36 is a side elevational view of the biased lever-arm of FIG. 35.

Referring to FIGS. 30-34 there is shown biased lever-arm 19 according to another embodiment that is similar to biased lever-arm 17 (seen in FIG. 22) and at least differences are discussed. In the illustrated embodiment, biased lever-arm 19 includes lever arm 24 and lever arm 25. In other embodiments, outer frame 480 can be employed instead of outer frame 481 of lever arm 25. Biased lever-arm 19 includes supports 42 supporting elongate support 510 where the elongate member is supported at each end by one of the supports 42, which are each secured therewith. With reference to FIGS. 31 and 34, outer frame 481 (or in other embodiments outer frame 480 seen in FIG. 14) is supported by annular flange 520 above elongate support 510, and inner frame 490 is supported by annular flange 580 below elongate support 510. Spring 60 and spring retainer 86 cooperate to bias outer frame 481 and are also located above elongate support 510. Outer frame 481 is restricted in angular rotation around pivot axis 110 due to elongate support 510, since by being located above elongate support 510 outer frame 481 contacts elongate support 510 while rotating about pivot axis 110. However, by proper selection of a spring constant for spring 60 that biases outer frame 481, the limited angular displacement about the pivot axis is not problematic. Another spring 60 and spring retainer 86 cooperate to bias inner frame 490 and are also located below elongate support 510. Inner frame 490 can rotate completely around pivot axis 110 since it is not obstructed by elongate support 510.

Figure 38:
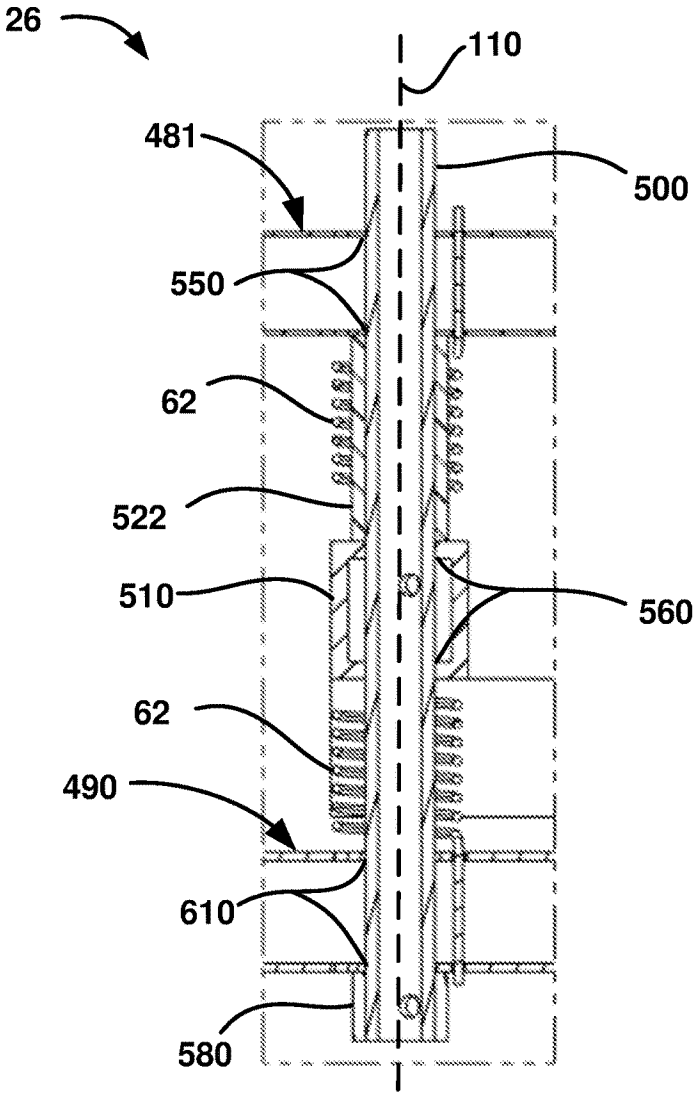
FIG. 38 is a cross-sectional view of a portion of the biased lever-arm of FIG. 37 taken along line A-A.
Figure 41:
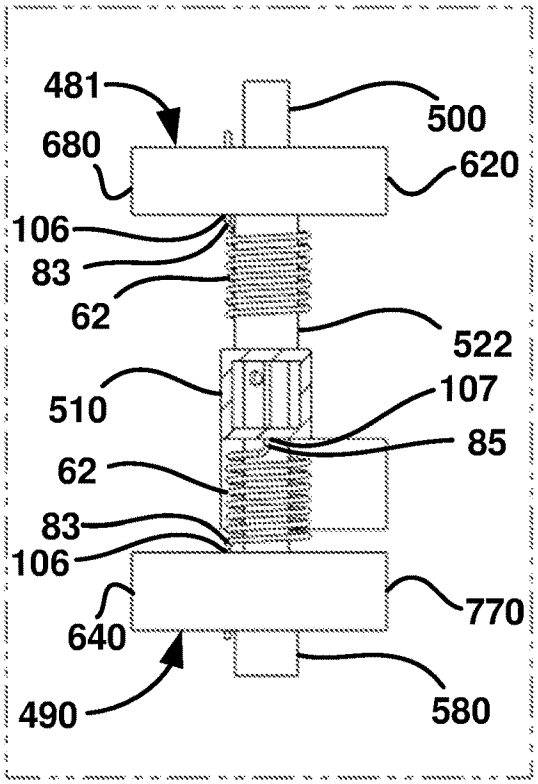
FIG. 41 is a cross-sectional view of a portion of the biased lever-arm of FIG. 39 taken along line C-C.
Figure 40:
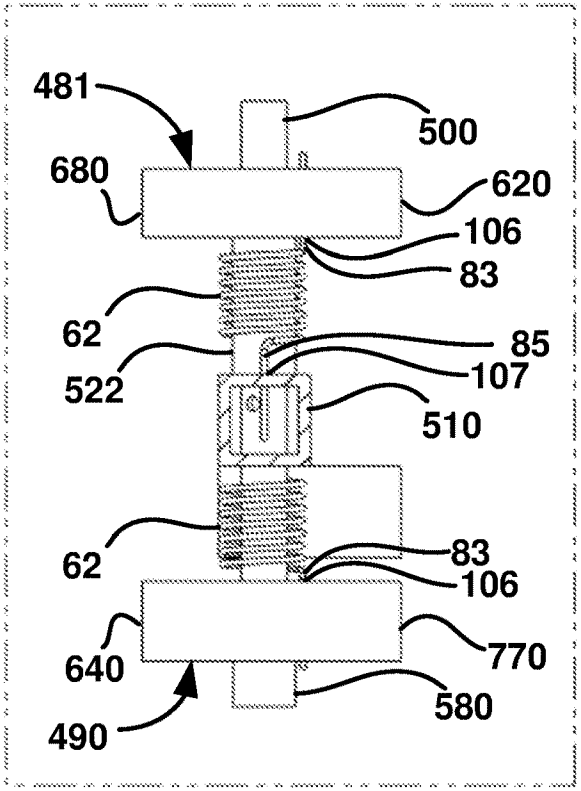
FIG. 40 is a cross-sectional view of a portion of the biased lever-arm of FIG. 39 taken along line B-B.
Figure 39:
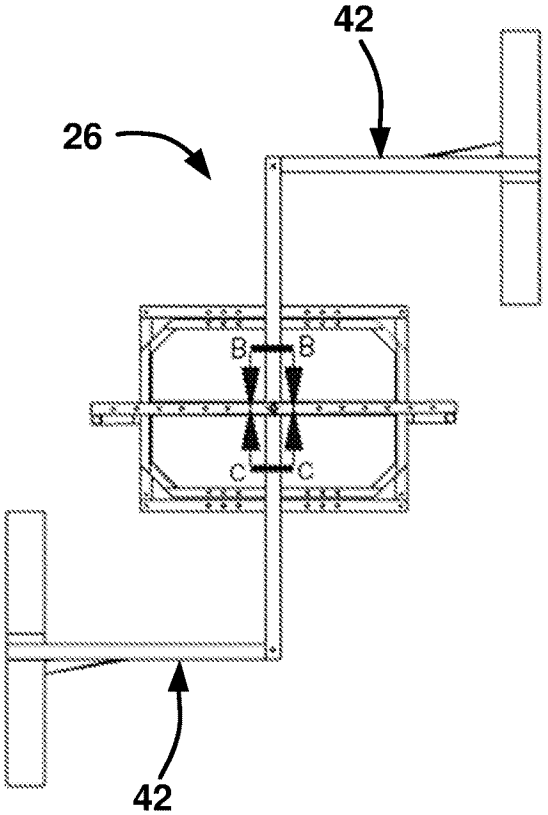
FIG. 39 is a top plan view of the biased lever-arm of FIG. 35.

Referring to FIGS. 35-41 there is shown biased lever-arm 26 according to another embodiment that is similar to biased lever-arm 19 (seen in FIG. 30) and at least differences are discussed. With reference to FIGS. 38, 40 and 41, elongate support 510 acts as a retaining member for springs 62 instead of dedicated spring retainers 86 (seen in FIG. 34). One spring 62 is retained by elongate member 680 of outer frame 481 (the base of yoke section 620) (or outer frame 480 in other embodiments) and elongate support 510, and the other spring 62 is retained by elongate member 770 of inner frame 490 (the base of yoke section 640) and elongate support 510. More particularly, referring first to spring 62 retained by outer frame 481 and elongate support 510 (best seen in FIG. 40), axial leg 83 extends into bore 106 of outer frame 481 and axial leg 85 extends into bore 107 of elongate support 510. Referring next to spring 62 retained by inner frame 490 and elongate support 510 (best seen in FIG. 41), axial leg 83 extends into bore 106 of inner frame 490 and axial leg 85 extends into bore 107 of elongate support 510. Annular flange 522 extends around cylindrical member 500 and is secured thereto, for example by a fastener, a locking pin, or a weld, and also functions to support outer frame 481 above spring 62. Preferably biased lever-arm 26 can be disassembled such that springs 62 can be exchanged with other springs with different spring constants and/or angular relationships of axial legs 83 and 85.

Figure 42:
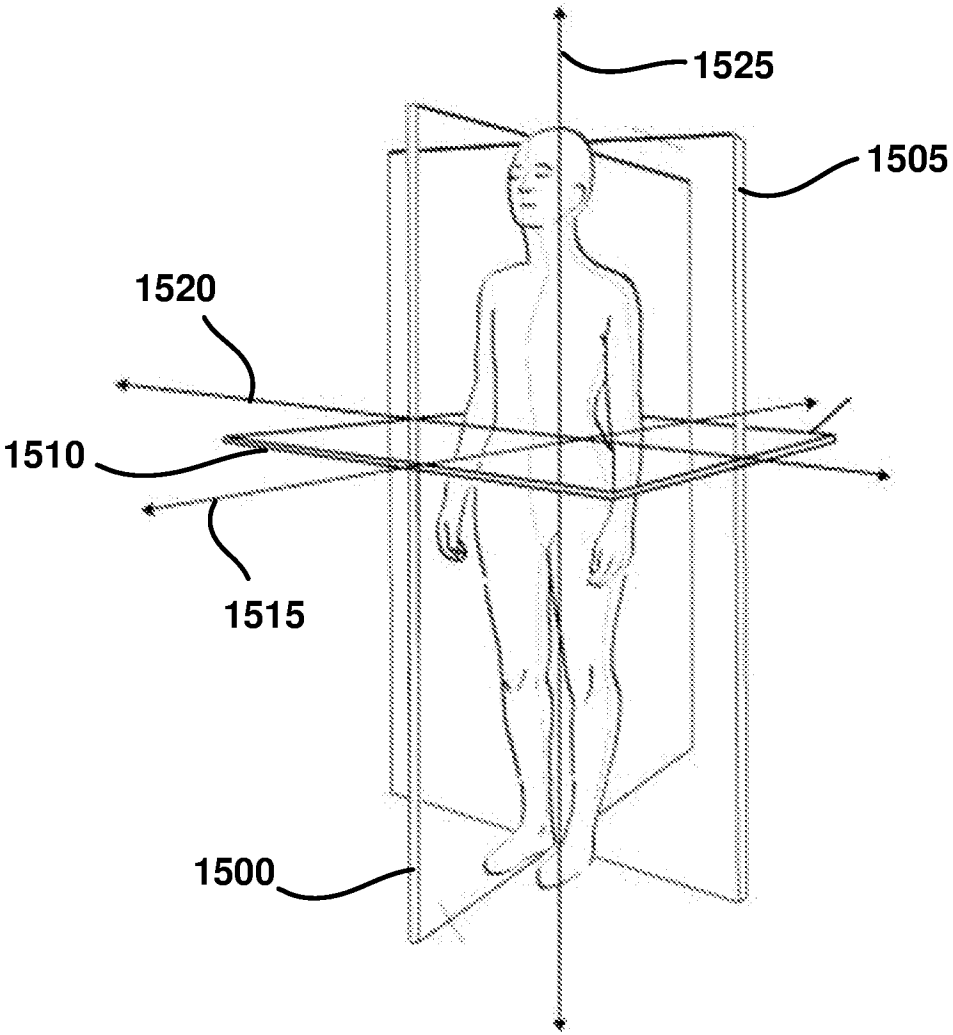
FIG. 42 is a perspective view of anatomical planes and axes of human movement.

Referring to FIG. 42, the various planes and axes of the body are illustrated and defined. The following terminology is used when describing the relative positions of the body parts or relationship between those parts. Anterior is toward or on the front of the body. Posterior is towards or on the back of the body. Superior is toward the head or upper part of a structure. Inferior is toward the lower part of a structure. Medial is toward or at the midline of the body. Lateral is away from the midline of the body. Proximal is closer to the origin of a point of reference. Distal is further from the origin or point of reference. With reference to FIG. 42, anatomical sagittal plane 1500 lies vertically and divides the body into right and left parts. Anatomical frontal plane 1505 also lies vertically and divides the body into anterior and posterior parts. Anatomical transverse plane 1510 lies horizontally and divides the body into superior and inferior parts. Anatomical sagittal axis 1515 passes horizontally from posterior to anterior and is formed by the intersection of anatomical sagittal plane 1500 and anatomical transverse plane 1510. Anatomical frontal axis 1520 passes horizontally from left to right and is formed by the intersection of anatomical frontal plane 1505 and anatomical transverse plane 1510. Anatomical longitudinal axis 1525 passes vertically from inferior to superior and is formed by the intersection of anatomical sagittal plane 1500 and anatomical frontal plane 1505. The anatomical longitudinal axis 1525 can correspond to a longitudinal axis of the torso of the user.

All embodiments herein employing lever arm 23 and lever arm 24 can in other embodiments employ only lever arm 23 or only lever arm 24. Similarly, all embodiments herein employing lever arm 24 and lever arm 25 can in other embodiments employ only lever arm 24 or only lever arm 25. Such embodiments can selectively set the vertical location of binding sections 630 and 650. Additionally, outer frame 480 and outer frame 481 can be employed interchangeably.

A location of binding sections 154 and 155 along anatomical longitudinal axis 1520 cooperates with harness 320, and preferably the location of binding sections 154 and 155 along anatomical longitudinal axis 1520 can be substantially the same as a location of harness 320 along anatomical longitudinal axis 1520. Similarly, a location of binding section 630 along anatomical longitudinal axis 1520 cooperates with harness 980, and preferably the location of binding section 630 along anatomical longitudinal axis 1520 can be substantially the same as a location of harness 980 along anatomical longitudinal axis 1520; and a location of binding section 650 along anatomical longitudinal axis 1520 cooperates with harness 990, and preferably the location of binding section 650 along anatomical longitudinal axis 1520 can be substantially the same as a location of harness 990 along anatomical longitudinal axis 1520.

Figure 43:
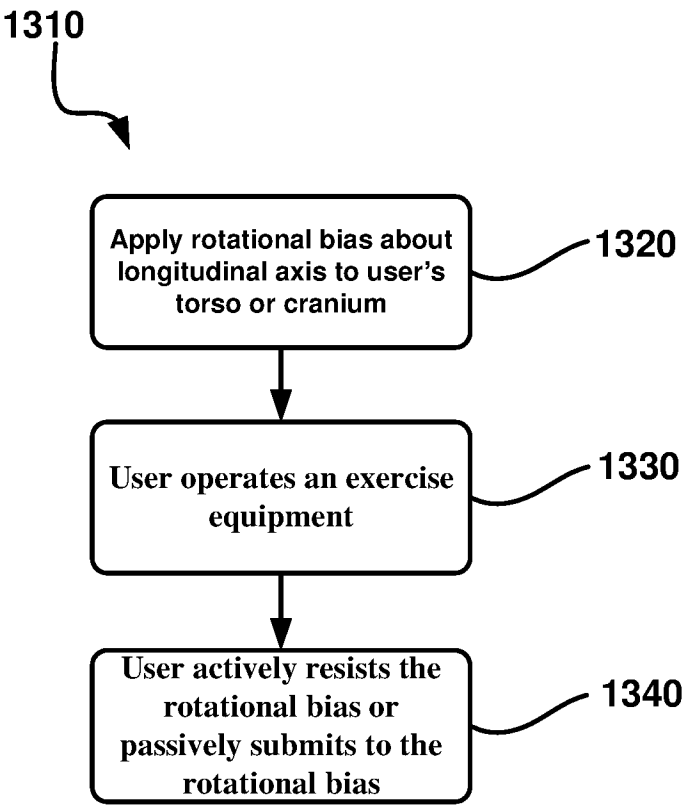
FIG. 43 is a physiotherapy method according to one embodiment.

Referring now to FIG. 43, physiotherapy method 1310 is now discussed. In step 1320 a rotational bias or torque about anatomical longitudinal axis 1525 of the user is applied directly to the torso of the user, or the cranium of the user when done safely, by employing one of biased lever-arms 10, 11, 12, 13, 14, 15, 16, 17, 18, 19, or 26. With regard to the torso, directly applying the rotational bias or torque to the torso means the rotational bias or torque is applied directly to the torso without being transmitted through the limbs (and particularly the arms) of the user. More particularly, the rotational bias or torque can be applied around the pelvic region, the lumbar spinal region, or the thoracic spinal region of the user. In step 1330 the user operates an exercise equipment, for example a treadmill, stationary bicycle, or step climber, particularly while the rotational bias of step 1320 is applied. When the exercise equipment is the treadmill, the user can walk either forwards or backwards. In step 1340, while using the exercise equipment, at least part of the time the user actively resists the rotational bias or passively submits to the rotational bias. By actively resisting the user tends to not let the rotational bias rotate the user about anatomical longitudinal axis 1525. By passively submitting the user tends to let the rotational bias rotate the user to or near an end of range of motion associated with that part of the torso (for example, the pelvic region, the lumbar spinal region, or the thoracic spinal region) or the cranium where the rotational bias is applied. The rotational bias can be clockwise or counter-clockwise. Preferably, the user alternates between using a clockwise rotational bias and a counter-clockwise rotational bias.

Figure 44:
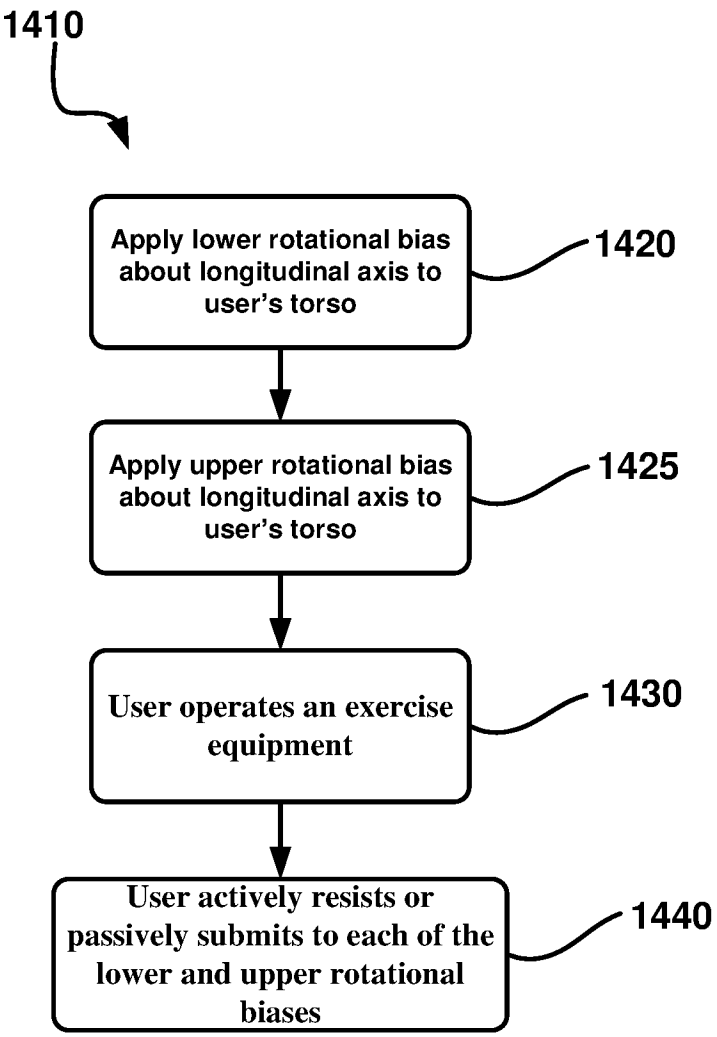
FIG. 44 is a physiotherapy method according to another embodiment.

Referring now to FIG. 44, physiotherapy method 1410 is now discussed. In step 1420 a lower rotational bias or torque about anatomical longitudinal axis 1525 of the user is directly applied to the torso of the user, and particularly to the pelvic region or the lumbar spinal region of the user. In step 1425 an upper rotational bias or torque about anatomical longitudinal axis 1525 of the user is directly applied to the torso of the user, and particularly the lumbar spinal region or the thoracic spinal region of the user. With regard to the torso, directly applying the lower rotational bias or the upper rotational bias to the torso means the lower rotational bias or the upper rotational bias are applied directly to the torso without being transmitted through the limbs (and particularly the arms) or the user. Preferably, when a bias is applied to the lumbar spinal region either the lower rotational bias is applied to the lumbar spinal region or the upper rotational bias is applied and not both the lower and upper rotational bias at the same time. The lower rotational bias and the upper rotational bias are applied, for example, by employing one of biased lever-arm 13, 16, 17, 18, 19, or 26. In step 1430 the user operates an exercise equipment, for example a treadmill, stationary bicycle, or step climber. When the exercise equipment is the treadmill, the user can walk either forwards or backwards. In step 1440, while using the exercise equipment, at least part of the time the user actively resists the lower rotational bias or passively submits to the lower rotational bias, and at least part of the time the user actively resists the upper rotational bias or passively submits to the upper rotational bias. By actively resisting the user tends to not let the rotational bias rotate the user about anatomical longitudinal axis 1525. By passively submitting the user tends to let the lower rotational bias and the upper rotational bias rotate the user to or near ends of ranges of motion associated with those parts of the torso (for example, the pelvic region, the lumbar spinal region, or the thoracic spinal region) where the lower rotational bias and the upper rotational bias, respectively are applied. The lower rotational bias can be clockwise or counter-clockwise, and the upper rotational bias can be clockwise or counter-clockwise. That is, there can be four combinations of rotational bias: (i) lower-clockwise, upper-clockwise (ii) lower-clockwise, upper-counter-clockwise (iii) lower-counter-clockwise, upper-clockwise, and (iv) lower-counter-clockwise, upper-counter-clockwise. Preferably, the user alternates between using a variety of the four combinations of rotational bias.

With biased lever-arm 10, 11, 12, 13, 14, 15, 16, 17, 18, 19, or 26, applying rotational biases or torques directly to the torso of the user without transmitting the rotational bias through the limbs of the user has a markedly different effect on the user than physiotherapy or rehabilitative equipment where the user engages the equipment with their hands such that the rotational bias and torques are transferred through the arms of the user. As an example of the distinction, compensational forces on a user with a leg length difference appear to occur as rotational forces on the pelvis (creating asymmetric pelvic tilt or pelvic obliquity) and on the chest (from the righting reflex to correct the line of sight, which is initiated by the head), and the hands and arms adjust due to the corrections from the pelvis and chest. An improved physiotherapeutic response can be obtained when the compensatory rotational forces on the pelvis and chest are counteracted by use of biased lever-arm 10, 11, 12, 13, 14, 15, 16, 17, 18, 19, or 26. Note that counteracting pelvic and/or chest rotational forces can be created by rotational forces directly from biased lever-arm 10, 11, 12, 13, 14, 15, 16, 17, 18, 19, or 26, or from the user in response to rotational forces from biased frame apparatuses 10, 11, 12, 13, 14, 15, 16, 17, 18, 19 or 26 that are similar to the compensatory rotational forces due to a condition experienced by the user, such as a leg length difference.

The techniques disclosed herein can help those with skeletal-muscular asymmetries to reduce strain and pain when they load their bodies such as when they exercise, perform work in the yard or perform typical chores throughout the day. The biased frame apparatuses hereinbefore disclosed can help the body adjust to using a heel lift. This is beneficial in achieving muscular symmetry across the pelvis. The body is remarkably adaptable and can mask limitations of range of motion in the various joints that can be uncovered and impact reduced by employing the biased frame apparatus disclosed herein in a variety of positions.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. An apparatus for physiotherapy comprising:

a lever arm;

a biasing device pivotally biasing the lever arm about a pivot axis;

a support configured for supporting the lever arm above an exercise equipment; and a harness configurable on a torso of a user to couple the user to the lever arm;

wherein the pivot axis corresponds to an anatomical longitudinal axis of the user and the torso of the user is biased by the lever arm about the anatomical longitudinal axis;

wherein the harness includes a coupler that couples the harness to the lever arm by at least one of a band, a belt, a carabiner, a connector, a cord, a fastener, a hook, a latch, a lock, a ring, a rope, a strap, a string, a strip, and VELCRO®; and wherein the coupler forms an angle less than or equal to 60 degrees with a line of force exerted by the lever arm on the coupler.

2. The apparatus as claimed in claim 1, wherein the lever arm comprises a frame including a yoke section.

3. The apparatus as claimed in claim 2, wherein the yoke section is an inverted U-shaped structure or a rotated C-shaped structure.

4. The apparatus as claimed in claim 2, wherein the frame further includes a binding section connected with the yoke section.

5. The apparatus as claimed in claim 4, wherein the binding section is an O-shaped structure, a D-shaped structure, a pair of L-shaped structures arranged like an O-shape, or a pair of I-shaped structures arranged side-by-side.

6. The apparatus as claimed in claim 4, wherein the yoke section comprises a base member and a pair of side members extending from the base member at opposite ends thereof, the binding section extending between and connected with the pair of side members.

7. The apparatus as claimed in claim 1, wherein the harness comprises at least one of a belt, clothes, a construction harness, a daisy chain loop sling, a first responder harness, a full-body harness, a mountain climbing harness, pants or shorts with belt loops, a strap, a vest-style harness, or a weight-lifting body belt.

8. The apparatus as claimed in claim 1, wherein when the lever arm is biased clockwise around the pivot axis, the coupler extends from the harness towards the lever arm in a clockwise direction around the pivot axis, and when the lever arm is biased counter-clockwise around the pivot axis, the coupler extends from the harness towards the lever arm in a counter-clockwise direction around the pivot axis.

9. The apparatus as claimed in claim 1, wherein the angle is less than or equal to 30 degrees.

10. The apparatus as claimed in claim 1, wherein the angle is less than or equal to 15 degrees.

11. The apparatus of claim 1, wherein the exercise equipment is one of a treadmill, a stationary bicycle, or a step climber.

12. The apparatus of claim 1, wherein the biasing device is a spring, an elastic strap, a rubber band, a bungee cord, an electromagnetic biasing device, a solenoid or an electric motor.

13. A method for physiotherapy comprising:

applying a rotational bias about an anatomical longitudinal axis of a user directly to a cranium of the user;

the user operating an exercise equipment while the rotational bias is applied; and the user actively resisting or passively submitting to the rotational bias at least part of the time while using the exercise equipment, wherein the exercise equipment is one of a treadmill, a stationary bicycle, or a step climber.

14. The method as claimed in claim 13, wherein the rotational bias is clockwise or counter-clockwise about the anatomical longitudinal axis.

15. The method as claimed in claim 13, wherein an unbiased position where the rotational bias about the anatomical longitudinal axis of the user is reduced to zero can be adjusted.

16. A method for physiotherapy comprising:

applying a lower rotational bias about an anatomical longitudinal axis of a user directly to a torso of the user;

applying an upper rotational bias about the anatomical longitudinal axis of the user directly to the torso of the user;

the user operating an exercise equipment while the lower rotational bias and the upper rotational bias are applied;

the user actively resisting or passively submitting to the lower rotational bias at least part of the time while using the exercise equipment; and the user actively resisting or passively submitting to the upper rotational bias at least part of the time while using the exercise equipment;

wherein one of:

the lower rotational bias is clockwise and the upper rotational bias is counter-clockwise about the anatomical longitudinal axis; or the lower rotational bias is counter-clockwise and the upper rotational bias is clockwise about the anatomical longitudinal axis.

17. The method as claimed in claim 16, wherein the lower rotational bias is applied to one of the pelvic region, the lumbar spinal region, or the abdomen of the user, and the upper rotational bias is applied to one of the lumber spinal region, the thoracic spinal region, or the chest of the user.

18. The method as claimed in claim 16, wherein a lower unbiased position where the lower rotational bias about the anatomical longitudinal axis of the user is reduced to zero can be adjusted; and an upper unbiased position where the upper rotational bias about the anatomical longitudinal axis of the user is reduced to zero can be adjusted.

19. The method as claimed in claim 16, wherein the exercise equipment is one of a treadmill, a stationary bicycle, or a step climber.

* * * * *